US012697526B2

(12) United States Patent
Abelbeck

(10) Patent No.: US 12,697,526 B2
(45) **Date of Patent: *Aug. 4, 2026**

(54) EXERCISE DEVICE WITH NATURAL GAIT MOTION

(71) Applicant: Blue Goji LLC, Austin, TX (US)

(72) Inventor: Kevin Gene Abelbeck, Fort Collins, CO (US)

(73) Assignee: BLUE GOJI LLC, Austin, TX (US)

( * ) Notice: Subject to any disclaimer, the term of this patent is extended or adjusted under 35 U.S.C. 154(b) by 69 days.

This patent is subject to a terminal disclaimer.

(21) Appl. No.: 18/433,350

(22) Filed: Feb. 5, 2024

(65) Prior Publication Data

US 2024/0252880 A1 Aug. 1, 2024

Related U.S. Application Data

(60) Continuation-in-part of application No. 18/299,017, filed on Apr. 11, 2023, now Pat. No. 12,324,948, and (Continued)

(51) Int. Cl.
*A63B 22/00* (2006.01)
*A63B 21/00* (2006.01)
(Continued)

(52) U.S. Cl.
CPC ..... *A63B 22/001* (2013.01); *A63B 21/015* (2013.01); *A63B 21/154* (2013.01); *A63B 21/225* (2013.01); *A63B 21/4033* (2015.10); *A63B 21/4034* (2015.10); *A63B 21/4035* (2015.10); *A63B 22/0056* (2013.01); *A63B 22/0664* (2013.01); *A63B 23/0423* (2013.01); *A63B 24/0087* (2013.01); *A63B 21/151* (2013.01); *A63B 2022/0051* (2013.01); (Continued)

(58) Field of Classification Search
None
See application file for complete search history.

(56) References Cited

U.S. PATENT DOCUMENTS 219,439 A 9/1879 Blend
681,664 A * 8/1901 Addleman ..... A63B 21/154 482/92
(Continued)

FOREIGN PATENT DOCUMENTS

EP 2000178 A1 12/2008

*Primary Examiner* — Shila Jalalzadeh Abyaneh
(74) *Attorney, Agent, or Firm* — GALVIN PATENT LAW LLC; Brian R. Galvin; Brian S. Boon

(57) ABSTRACT

An exercise machine with a more natural gait which, in some embodiments, further allows for a variable stride length while in use. In one configuration, each side of the exercise machine has a first crank assembly connected at an upper location on a pedal arm and a second crank connected at a middle location on the pedal arm, and a pedal is attached to a lower location of the pedal arm. The first crank assembly is connected to the pedal arm by a crank arm. The second crank assembly is connected to the pedal arm via a crank arm pivotally attached to a crank link. The path of each pedal is determined by the lengths of crank arms and crank links of the first and second crank assemblies rotating in synchronous motion.

5 Claims, 29 Drawing Sheets

Related U.S. Application Data a continuation-in-part of application No. 18/171,330, filed on Feb. 18, 2023, now Pat. No. 11,914,776, said application No. 18/299,017 is a division of application No. 17/405,347, filed on Aug. 18, 2021, now Pat. No. 11,623,117, said application No. 17/030,233 is a continuation-in-part of application No. 17/030,195, filed on Sep. 23, 2020, now abandoned, said application No. 18/171,330 is a continuation of application No. 17/030,233, filed on Sep. 23, 2020, now Pat. No. 11,662,818, which is a continuation-in-part of application No. 16/927,704, filed on Jul. 13, 2020, now abandoned, which is a continuation of application No. 16/867,238, filed on May 5, 2020, now abandoned, which is a continuation-in-part of application No. 16/793,915, filed on Feb. 18, 2020, now abandoned, said application No. 17/030,195 is a continuation-in-part of application No. 16/781,663, filed on Feb. 4, 2020, now Pat. No. 11,191,996, which is a continuation-in-part of application No. 16/354,374, filed on Mar. 15, 2019, now Pat. No. 10,549,153, said application No. 16/793,915 is a continuation-in-part of application No. 16/255,641, filed on Jan. 23, 2019, now Pat. No. 10,561,900, which is a continuation of application No. 16/223,034, filed on Jan. 23, 2019, now Pat. No. 10,688,341, said application No. 16/354,374 is a continuation-in-part of application No. 16/176,511, filed on Oct. 31, 2018, now Pat. No. 10,960,264, said application No. 16/223,034 is a continuation-in-part of application No. 16/176,511, filed on Oct. 31, 2018, now Pat. No. 10,960,264, which is a continuation-in-part of application No. 16/011,394, filed on Jun. 18, 2018, now Pat. No. 10,155,133, which is a continuation-in-part of application No. 15/853,746, filed on Dec. 23, 2017, now Pat. No. 10,265,578, said application No. 17/405,347 is a continuation of application No. 15/609,910, filed on May 31, 2017, now Pat. No. 11,123,598, said application No. 15/853,746 is a continuation of application No. 15/219,115, filed on Jul. 25, 2016, now Pat. No. 9,849,333, said application No. 15/219,115 is a continuation-in-part of application No. 15/193,112, filed on Jun. 27, 2016, now abandoned, which is a continuation-in-part of application No. 15/187,787, filed on Jun. 21, 2016, now Pat. No. 10,124,255, which is a continuation-in-part of application No. 15/175,043, filed on Jun. 7, 2016, now Pat. No. 9,766,696, and a continuation-in-part of application No. 14/846,966, filed on Sep. 7, 2015, now Pat. No. 10,080,958, and a continuation-in-part of application No. 14/012,879, filed on Aug. 28, 2013, now Pat. No. 10,737,175.

(60) Provisional application No. 62/697,973, filed on Jul. 13, 2018, provisional application No. 62/330,602, filed on May 2, 2016, provisional application No. 62/330,642, filed on May 2, 2016, provisional application No. 62/310,568, filed on Mar. 18, 2016, provisional application No. 61/696,068, filed on Aug. 31, 2012.

(51) Int. Cl.

| | |
|---|---|
| ***A63B 21/015*** | (2006.01) |
| ***A63B 21/22*** | (2006.01) |
| ***A63B 22/06*** | (2006.01) |
| ***A63B 23/04*** | (2006.01) |
| ***A63B 24/00*** | (2006.01) |

(52) U.S. Cl.

CPC ..... *A63B 2022/0676* (2013.01); *A63B 2022/0688* (2013.01)

(56) References Cited

U.S. PATENT DOCUMENTS

| | | | | |
|---|---|---|---|---|
| 2,872,191 | A | 2/1959 | Gallo | |
| 3,758,111 | A | 9/1973 | Agamian | |
| 3,759,511 | A | 9/1973 | De et al. | |
| 3,820,820 | A | 6/1974 | Kutz | |
| 4,185,622 | A | 1/1980 | Swenson | |
| 4,188,030 | A | 2/1980 | Hooper | |
| 4,470,597 | A | 9/1984 | Mcfee | |
| 4,564,206 | A | 1/1986 | Lenhardt | |
| 4,712,790 | A | 12/1987 | Szymski | |
| 4,779,863 | A | 10/1988 | Yang | |
| 4,786,050 | A | 11/1988 | Geschwender | |
| 4,850,585 | A | 7/1989 | Dalebout | |
| 5,135,447 | A | 8/1992 | Robards, Jr. et al. | |
| 5,290,211 | A | 3/1994 | Stearns | |
| 5,401,226 | A | 3/1995 | Stearns | |
| 5,433,680 | A | 7/1995 | Knudsen | |
| 5,527,246 | A | 6/1996 | Rodgers, Jr. | |
| 5,529,555 | A | 6/1996 | Rodgers, Jr. | |
| 5,540,637 | A | 7/1996 | Rodgers, Jr. | |
| 5,549,526 | A | 8/1996 | Rodgers, Jr. | |
| 5,573,480 | A | 11/1996 | Rodgers, Jr. | |
| 5,577,985 | A | 11/1996 | Miller | |
| 5,591,107 | A | 1/1997 | Rodgers, Jr. | |
| 5,637,058 | A | 6/1997 | Rodgers, Jr. | |
| 5,707,321 | A | 1/1998 | Maresh | |
| 5,725,457 | A | 3/1998 | Maresh | |
| 5,792,028 | A | 8/1998 | Jarvie | |
| 5,800,315 | A | 9/1998 | Yu et al. | |
| 5,876,307 | A * | 3/1999 | Stearns | A63B 22/0664 482/51 |
| 5,876,308 | A | 3/1999 | Jarvie | |
| 5,897,463 | A | 4/1999 | Maresh | |
| 6,004,244 | A | 12/1999 | Simonson | |
| 6,083,143 | A | 7/2000 | Maresh | |
| 6,196,948 | B1 * | 3/2001 | Stearns | A63B 22/0012 482/52 |
| 6,248,044 | B1 | 6/2001 | Stearns et al. | |
| 6,398,695 | B2 | 6/2002 | Miller | |
| 6,409,632 | B1 | 6/2002 | Eschenbach | |
| 6,482,132 | B2 | 11/2002 | Eschenbach | |
| 6,551,218 | B2 | 4/2003 | Goh et al. | |
| 6,761,665 | B2 | 7/2004 | Nguyen | |
| 6,949,054 | B1 | 9/2005 | Stearns et al. | |
| 7,060,005 | B2 | 6/2006 | Carlsen et al. | |
| 7,086,993 | B1 | 8/2006 | Maresh | |
| 7,137,927 | B2 | 11/2006 | Maresh et al. | |
| 7,169,089 | B2 | 1/2007 | Rodgers et al. | |
| 7,214,168 | B2 * | 5/2007 | Rodgers, Jr. | A63B 22/001 482/52 |
| 7,285,075 | B2 | 10/2007 | Cutler et al. | |
| 7,344,480 | B2 | 3/2008 | Maresh et al. | |
| 7,485,080 | B1 | 2/2009 | Chuang et al. | |
| 7,520,839 | B2 | 4/2009 | Rodgers, Jr. et al. | |
| 7,530,926 | B2 | 5/2009 | Rodgers, Jr. et al. | |
| 7,544,152 | B2 | 6/2009 | Dey et al. | |
| 7,556,691 | B2 | 7/2009 | Rogers et al. | |
| 7,608,018 | B2 | 10/2009 | Chuang et al. | |
| 7,611,446 | B2 | 11/2009 | Chuang et al. | |
| 7,645,215 | B2 * | 1/2010 | Gordon | A63B 22/0056 482/52 |
| 7,651,445 | B1 | 1/2010 | Chen | |
| 7,708,669 | B2 | 5/2010 | Rodgers, Jr. | |
| 7,833,134 | B2 | 11/2010 | Gordon | |
| 7,862,482 | B1 | 1/2011 | Hsu | |
| 8,109,861 | B2 | 2/2012 | Gordon et al. | |
| 8,449,437 | B1 * | 5/2013 | Maresh | A63B 22/001 482/52 |

(56) References Cited

U.S. PATENT DOCUMENTS

| | | | | |
|---|---|---|---|---|
| 8,740,754 | B2 | 6/2014 | Miller | |
| 8,852,059 | B1 * | 10/2014 | Stearns | A63B 22/001 482/52 |
| 8,864,631 | B1 * | 10/2014 | Stearns | A63B 24/0087 482/52 |
| 9,073,597 | B2 | 7/2015 | Rundini | |
| 9,114,275 | B2 | 8/2015 | Lu et al. | |
| 9,630,052 | B2 | 4/2017 | Peng et al. | |
| 9,764,187 | B1 * | 9/2017 | Stearns | A63B 22/06 |
| 9,925,412 | B1 * | 3/2018 | Lu | A63B 22/001 |
| 2005/0124466 | A1 | 6/2005 | Rodgers, Jr. et al. | |
| 2006/0079381 | A1 * | 4/2006 | Cornejo | A63B 71/0619 482/52 |
| 2006/0172865 | A1 * | 8/2006 | Dey | A63B 22/0007 482/52 |
| 2008/0051258 | A1 | 2/2008 | Schmehl et al. | |
| 2008/0261778 | A1 | 10/2008 | Chuang et al. | |
| 2008/0269023 | A1 * | 10/2008 | Chuang | A63B 22/0017 482/52 |
| 2011/0039662 | A1 * | 2/2011 | Gordon | A63B 22/0664 482/52 |
| 2013/0210585 | A1 * | 8/2013 | Arnold | A63B 22/001 482/52 |
| 2014/0141939 | A1 * | 5/2014 | Wu | A63B 22/0017 482/52 |
| 2014/0249000 | A1 * | 9/2014 | Lu | A63B 22/001 482/52 |
| 2016/0339288 | A1 * | 11/2016 | Li | A63B 22/0056 |
| 2020/0078251 | A1 * | 3/2020 | Benda | A61H 3/008 |

* cited by examiner

EXERCISE DEVICE WITH NATURAL GAIT MOTION

CROSS-REFERENCE TO RELATED APPLICATIONS

Priority is claimed in the application data sheet to the following patents or patent applications, each of which is expressly incorporated herein by reference in its entirety:

Ser. No. 18/299,017
Ser. No. 17/405,347
Ser. No. 15/609,910
62/358,517
Ser. No. 18/171,330
Ser. No. 17/030,233
Ser. No. 17/030,195
Ser. No. 16/781,663
Ser. No. 16/354,374
Ser. No. 16/176,511
Ser. No. 16/011,394
Ser. No. 15/853,746
Ser. No. 15/219,115
Ser. No. 15/193,112
Ser. No. 15/187,787
Ser. No. 15/175,043
62/310,568
Ser. No. 14/846,966
Ser. No. 14/012,879
61/696,068
62/330,602
62/330,642
Ser. No. 16/927,704
Ser. No. 16/867,238
Ser. No. 16/793,915
Ser. No. 16/255,641
Ser. No. 16/223,034
Ser. No. 16/176,511
62/697,973

BACKGROUND OF THE INVENTION

Field of the Art

The present invention generally relates to exercise equipment, and more particularly, to exercise devices providing walking or running motions.

Discussion of the State of the Art

The need for physical exercise is especially important in today's world of drive through windows and sitting in front of a computer all day. It is suggested that cardiovascular exercise is most beneficial if the user can obtain an elevated heart rate for at least twenty minutes of sustained exercise. This type of exercise may vary according to the needs and personal preference of the user, but for many people a movement that employs larger muscles, such as those which move the legs and hips may be desirable, as these are capable of doing the most work. For many sedentary individuals the accumulation of excess bodyfat may be a concern. The more work the body does, the more energy the body uses to perform that work. In the human body, most energy storage is in the form of bodyfat. Therefore, using larger muscles to do more work may enable a quicker end result on reducing bodyfat and increasing cardiovascular health. Adding an upper body system to an exercise device may further help by taxing additional muscle groups and increase the work output of the body over time.

It may be beneficial for the user to perform an activity that has a familiar basis to the normal function of the body, such as walking or running. Walking may be preferred for many users, as the impact forces on the legs are less compared to those found in running for the same person, even at the same speed. Using a walking motion may enable some participants to perform the activity that they could not perform under the higher running loads. Also, the lower impact stress may allow some people to perform the activity longer and therefore have a higher cumulative energy expenditure compared to running, even considering the higher energy expenditure per unit of time with running as compared to walking. Increasing the energy expenditure and still maintaining a walking gait may be accomplished by increasing the force required to move the pedals of a machine that simulates walking, or altering the angle to simulate walking up a hill. Either or both may provide a useful alternative to walking on a street or road where the user may be subjected to extreme weather conditions, traffic or physical dangers not found in their home or other controlled environment.

Treadmills have typically been used, but they can be large, expensive and noisy. The noise is due at least partially to the friction between the moving belt and the supporting deck under the belt that occurs with each step. Where there is friction there is wear. The decks must be regularly replaced or lubricated and the belts replaced.

It should, therefore, be appreciated that there is a need for an exercise device that allows the user to simulate walking or other bipedal movement that can be done indoors, with a small footprint and with minimal noise and parts wear. The present invention fulfills this need and others.

Existing elliptical exercise machines attempt to provide a low-impact exercise motion, but force a gait that is strictly elliptical in nature, which is not consistent with a natural walking motion. Further, existing elliptical exercise machines do not allow for a variable stride length. What is needed is a low-impact exercise machine similar to existing elliptical-type exercise machines, but with a more natural gait motion.

SUMMARY OF THE INVENTION

Accordingly, the inventor has conceived and reduced to practice an exercise machine with a more natural gait which, in some embodiments, further allows for a variable stride length while in use. In one configuration, each side of the exercise machine has a first crank assembly connected at an upper location on a pedal arm and a second crank connected at a middle location on the pedal arm, and a pedal is attached to a lower location of the pedal arm. The first crank assembly is connected to the pedal arm by a crank arm. The second crank assembly is connected to the pedal arm via a crank arm pivotally attached to a crank link. The path of each pedal is determined by the lengths of crank arms and crank links of the first and second crank assemblies rotating in synchronous motion.

According to a preferred embodiment, an exercise device is disclosed comprising: a frame; a first and a second crank system mounted opposing sides of the frame adapted for positioning a user therebetween, each of the first and second crank system comprising a first crank assembly rotatable about a first axis and a second crank assembly rotatable about a second axis with the first and second axes each being displaced from the other, each of the first crank assemblies comprising a first crank arm, and each of the second crank assemblies comprising a second crank arm; a pair of synchronous control system assemblies one mechanically coupled to the first crank system and the other mechanically coupled to the second crank system, each synchronous control system assembly of the pair of synchronous control system assemblies being mechanically coupled to the first and second crank assemblies of the corresponding crank system in a configuration that allows for 360 degrees of synchronous rotation of the first and second crank assemblies, wherein each first crank arm of each first crank assembly rotates in the same direction as the second crank arm of each second crank assembly by the corresponding synchronous control system assembly of the pair of synchronous control system assemblies; a pair of pedal arms, one coupled to the first crank system and the other coupled to the second crank system, each of the pair of pedal arms being pivotally coupled at a first end to the first crank arm of the first crank assembly and being pivotally coupled at a second end to a pedal; a pair of movable crank links, one corresponding to each of the first and second crank systems, each of the pair of movable crank links comprising a first attachment point, a second attachment point, and a flexible attachment between the first attachment point and second attachment point, wherein the first attachment point of each movable crank link is pivotally coupled to the pedal arm of its corresponding crank system and the second attachment point of each movable crank is pivotally coupled to the second crank arm of its corresponding second crank assembly.

According to an aspect of an embodiment, each of the movable crank link of the pair of movable crank links comprises a first link and a second link, wherein the first attachment point of the movable crank link is proximal to a first end of the first link and the second attachment point of the movable crank link is proximal to a first end the second link, and the attachment point comprises a pivoting attachment of the first and second links.

According to an aspect of an embodiment, the pivoting attachment of the first and second links is at a medial location of both the first and second links, such that a second end of the first link distal from the first attachment point extends past the attachment point and second end of the second link distal to the second attachment point extends past the attachment point.

According to an aspect of an embodiment, a first spring is attached between the second end of the first link the second end of the second link, and a second spring is attached between the second end of the first link and a medial location of the second link.

According to an aspect of an embodiment, a first spring is attached between the second end of the second link the second end of the first link, and a second spring is attached between the second end of the second link and a medial location of the first link.

BRIEF DESCRIPTION OF THE DRAWING FIGURES

Embodiments of the present invention will now be described, by way of example only, with reference to the following drawings, in which.

DETAILED DESCRIPTION OF THE INVENTION

Figure 1:
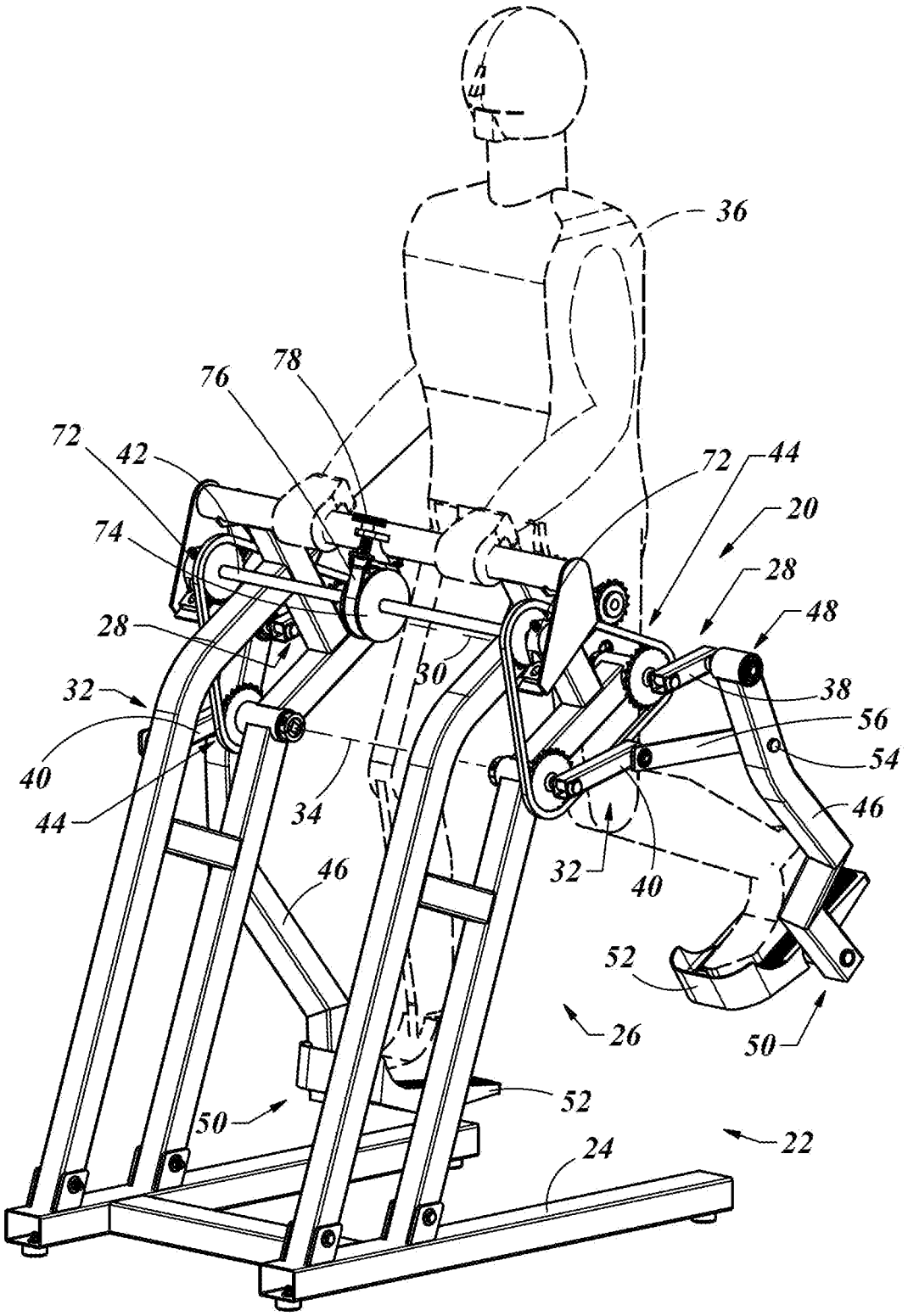
FIG. 1 is an isometric view of an exercise device, presented in accordance with the present invention.
Figure 2:
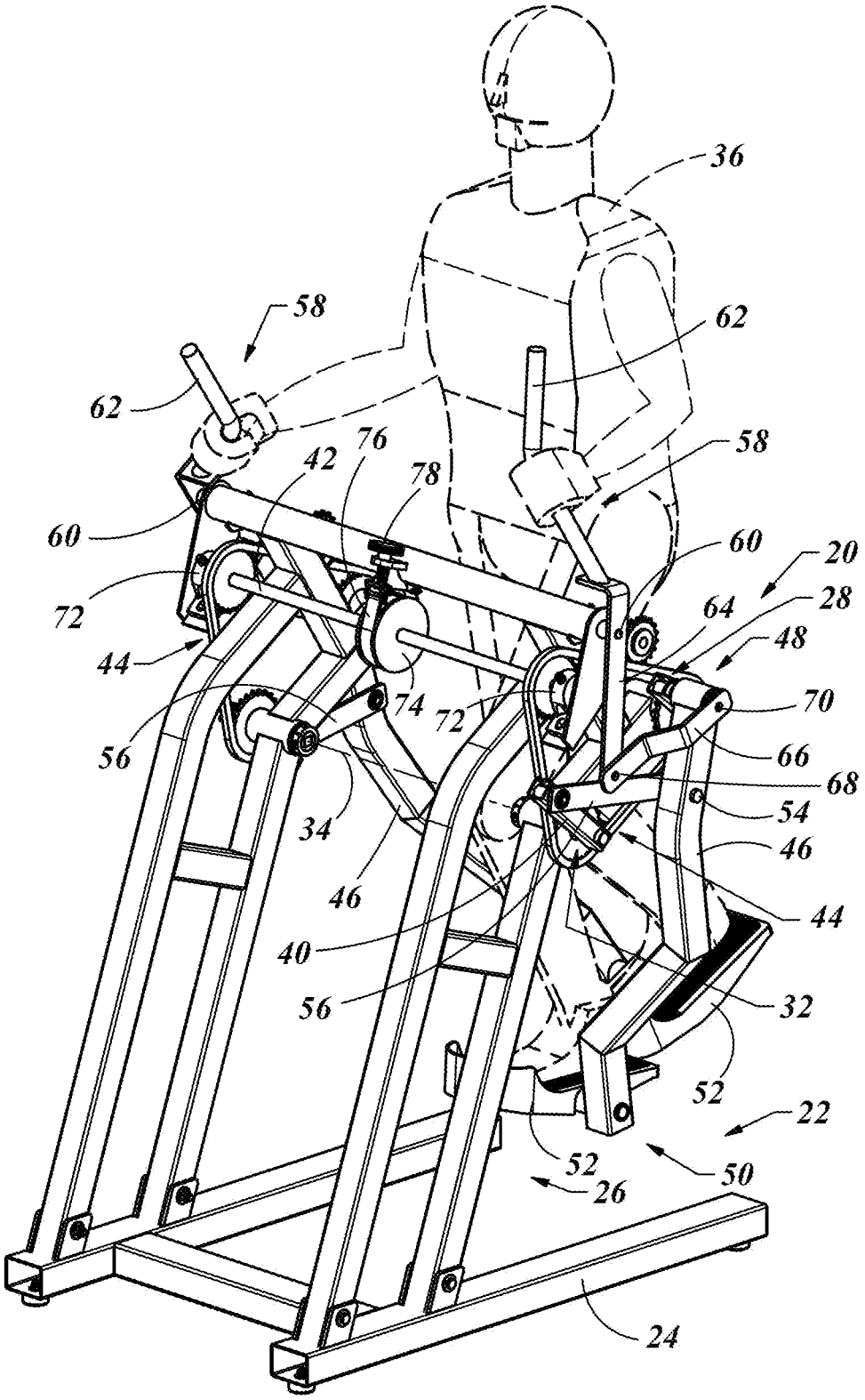
FIG. 2 is an isometric view of an exercise device which includes drive handles, the Figure presented in accordance with the present invention.
Figure 3:
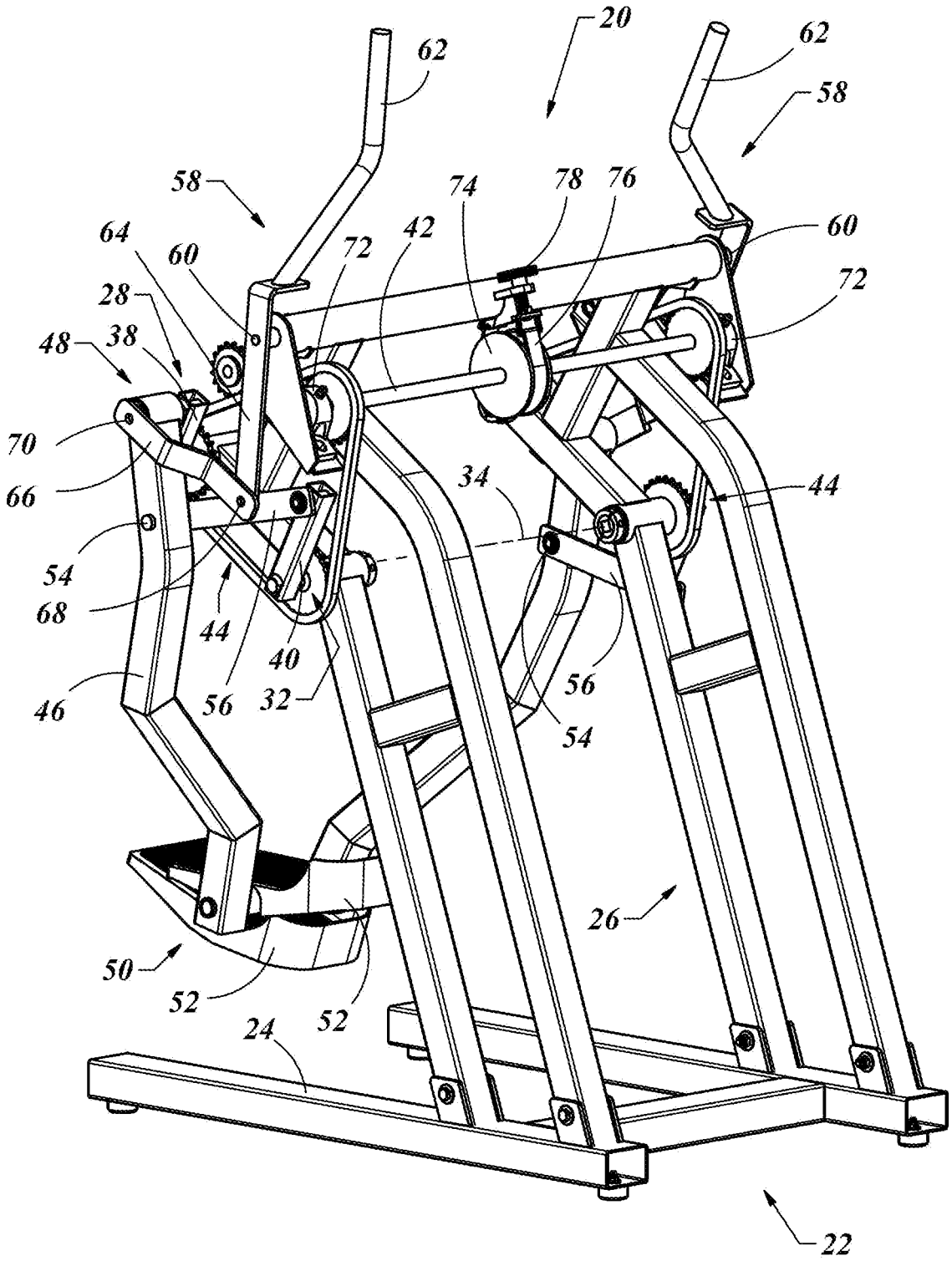
FIG. 3 is an isometric view of the exercise device shown as shown in FIG. 2, shown without a simulated user and from a right front viewpoint.
Figure 4:
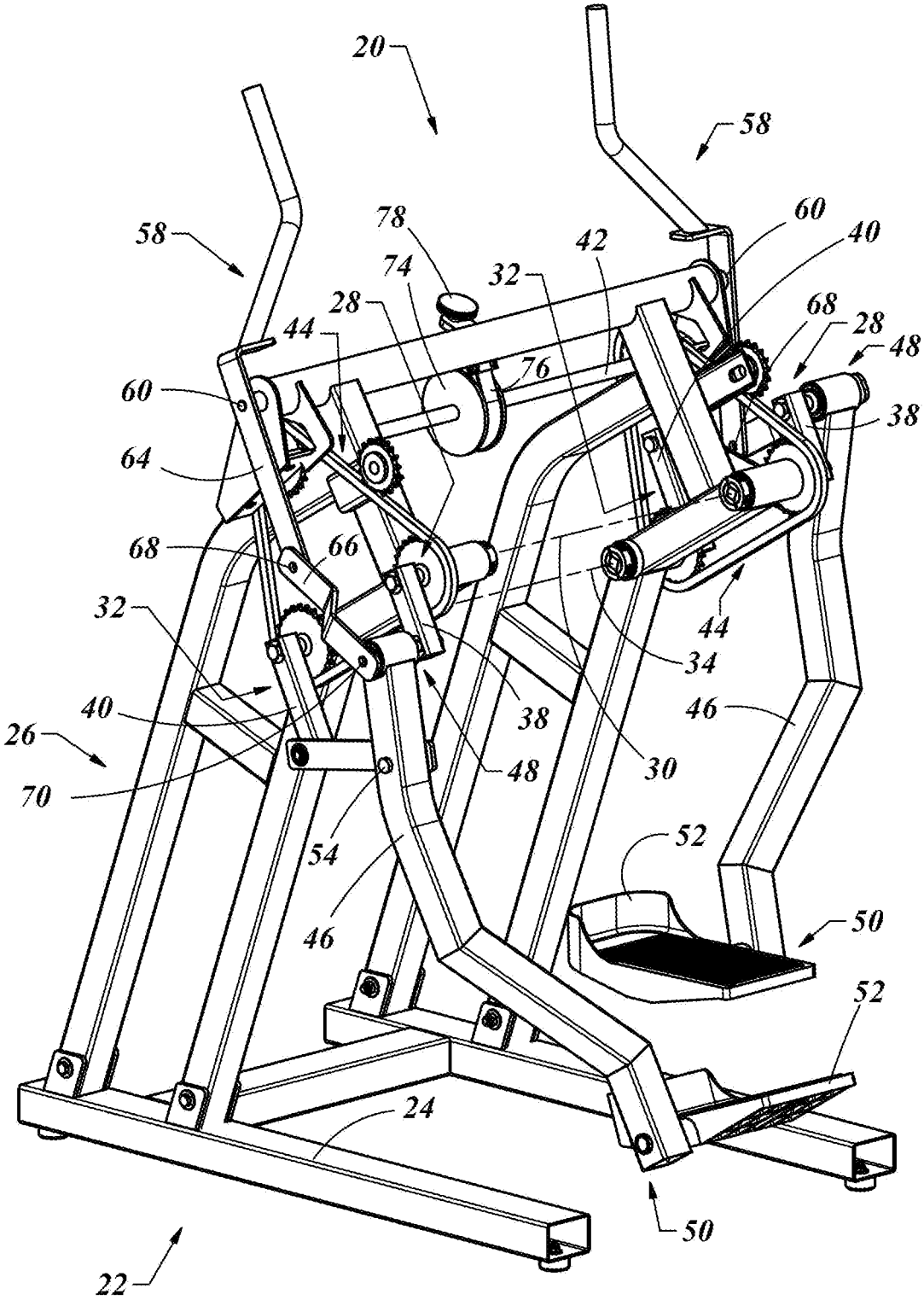
FIG. 4 is an isometric view from the left rear of the exercise device as shown in FIG. 3.

The inventor has conceived and reduce to practice an exercise machine with a more natural gait which, in some embodiments, further allows for a variable stride length while in use. In one configuration, each side of the exercise machine has a first crank assembly connected at an upper location on a pedal arm and a second crank connected at a middle location on the pedal arm, and a pedal is attached to a lower location of the pedal arm. The first crank assembly is connected to the pedal arm by a crank arm. The second crank assembly is connected to the pedal arm via a crank arm pivotally attached to a crank link. The path of each pedal is determined by the lengths of crank arms and crank links of the first and second crank assemblies rotating in synchronous motion.

A control system may be provided that may be in communication with the first crank assembly and the second crank assembly, the control system may provide a synchronous movement of the first crank assembly relative to the second crank assembly. A pedal arm may have a first end pivotally coupled to the first crank assembly and a pedal positioned on a second end of the pedal arm. In addition, a crank link may have one end coupled to the second crank assembly and a second end coupled to the pedal arm. The first crank link may be movably coupled to a location on the first pedal arm and then moved to a second position on the first pedal arm, thereby changing the path of movement of the pedals.

The control system may include a drive shaft rotateably connected to the frame, which may provide mechanical communication between the first crank arm and the second crank arm of the first crank assembly. The control system may also include a drive member selected from the groups consisting of a belt, roller chain, a synchronous belt, a v-belt and a poly-v belt. The control system may also include a torque linkage including a link rod rotateably coupled to the second crank assembly and the drive shaft. The torque linkage may transfer power between the second crank assembly and the drive shaft operating in cooperation with the drive member. A braking system may be provided that may be in mechanical communication with the drive shaft, which may provide a resistance to movement of first crank arm and the second crank arm of the first crank assembly and the second crank assembly.

The exercise device may also include a support frame which may support the first crank assembly and the second crank assembly. The support frame may be movably mounted to a base frame, such that the orientation of the first axis or the second axis may be altered with respect to the base frame and thereby vary the path of the pedals.

The system may include a pair of drive handles pivotally coupled to the frame, each one of the pair of drive handles may include a hand grip on a first end and a drive lever on a second end. A handle link may also be provided with a first end pivotally coupled to the first crank assembly and a second end pivotally coupled to the drive lever.

For purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

Detailed Descriptions of the Drawing Figures

With reference to the illustrative drawings, and particularly to FIG. 1, there is shown an exercise device 20. The exercise device 20 may include a frame 22, which may include a base frame 24 and a support frame 26. The support frame 26 may be adapted to support a first crank assembly 28, which may be journaled to the support frame 26 to allow for rotational movement of the first crank assembly 28 about a first axis 30. A second crank assembly 32 may be journaled to the support frame 26 about a second axis 34. In this disclosure the locations of the first axis 30 and the second axis 34 may be positioned to cause a potential interference with a user 36 using the exercise device 20. To solve this problem, the first crank assembly 28 and the second crank assembly 32 may each be split into a left crankset and a right crankset. To maintain that the first crank arms 38 and the second crank arms 40 of the first crank assembly 28 and the second crank assembly 32 respectively, may be positioned to be 180° out of phase with the other crank arm (38 and 40) of each crankset (28 and 32), a drive shaft 42 may also be journaled to the support frame 26 as illustrated.

It may be desirable for the first crank assembly 28 and the second crank assembly 32 to move in a synchronous manner with respect to one another. This may be accomplished by the use of a control system 44. The control system 44 may be comprised of a roller chain, a drive belt, a gearing system or any other mechanical transmission elements known in the art. In that the first axis 30 and the second axis 34 may not allow a direct communication between the right and left portions of the first crank assembly 28 or the second crank assembly 32, the control system 44 may also be in mechanical communication with the driveshaft 42. In that the driveshaft 42 may be located in position to mechanically span the entire width of the exercise device 20, the driveshaft 42 with the control system 44 may then act to connect the left and right portions of each of the first crank assembly 28 and the second crank assembly 32 as well as provide for synchronous rotation of the first crank assembly 28 with respect to the second crank assembly 32.

A pedal arm 46 may be rotatably coupled to the first crank assembly 28 on a first end 48 of the pedal arm 46. On a second end 50 of the pedal arm 46 a pedal 52 may be provided, which may be adapted to support the weight of the user 36. Between the first end 48 and the second end 50 of the pedal arm 46, a crank link pin 54 may be provided. The crank link pin 54 may be pivotally coupled to a crank link 56 and the crank link 56 may also be coupled to the second crank assembly 32, thereby connecting the pedal arm 46 to the second crank assembly 32.

It is important to note that in these preferred embodiments of the exercise device 20, the drive shaft 42 is positioned such that it is not in line with the first axis 30 or the second axis 34. That is because both the first axis 30 and the second axis 34 may be positioned to potentially interfere with the movement of the user 36. As such, the drive shaft 42 may be moved to a position that is unlikely to interfere with the movement of the legs of the user 36. It is possible that the second axis 34, and the second crank assembly 32, could be moved far enough forward to avoid the legs of the user 36. If that were done, the drive shaft 42 could directly connect the second crank assembly 32. The crank link 56 may then be increased in length in accordance with the increase in dimension of the relocation of the second axis 34 relative to the current position. This would eliminate the need for some components in the system. The applicant recognizes this could be done and hereby includes this as a variation to the disclosed embodiments even though this is not shown in any of the Figures.

With reference to FIGS. 2-5, a similar exercise device 20 is shown with the addition of drive handles 58, which may be pivotally coupled to the frame 22 about a pivot pin 60. The drive handles 58 may each include a hand grip 62 adapted to be gripped by the hands of the user 36. The drive handles 58 may also include a drive lever 64, which may be coupled to a handle link 66 about a pivot 68. The handle link 66 may include a second pivot 70, which may be mounted to the first crank assembly 28 at second pivot 70. Therefore, the user 36 may be positioned on the pedals 52 of the pedal arms 46 and perform a walking motion such that the first crank assembly 28 may provide a vertical displacement of each pedal arm 46, and therefore the pedal 52, while the second crank assembly 32 may provide for horizontal displacement of the pedal 52 by way of the crank link 56. This movement may drive the driveshaft 42, thus causing it to rotate about the bearings 72, which may be mounted to the support frame 26 of the frame 22.

To provide a smooth movement of the pedals 52 a flywheel 74 may be coupled to the driveshaft 42, whereby rotation of the driveshaft 42 about the bearings 72 may cause a similar rotation of the flywheel 74. It may also be desirable to include a braking system to resist the movement of the pedals 52. A braking system may include a friction strap 76 mounted to a screw 78, which may be mounted to the support frame 26. Therefore, as the screw 78 is advanced this may increase the tension in the friction strap 76, which may increase the drag and therefore increase the resistance to movement of the flywheel 74. This may increase the work necessary to be provided by the user 36, thus increasing the intensity of the exercise. In a similar manner, any magnetic form of resistance known to the art, such as an electric motor, an eddy current brake or any other braking system may be used in place of the combination of the friction strap 76 and screw 78.

Figure 5:
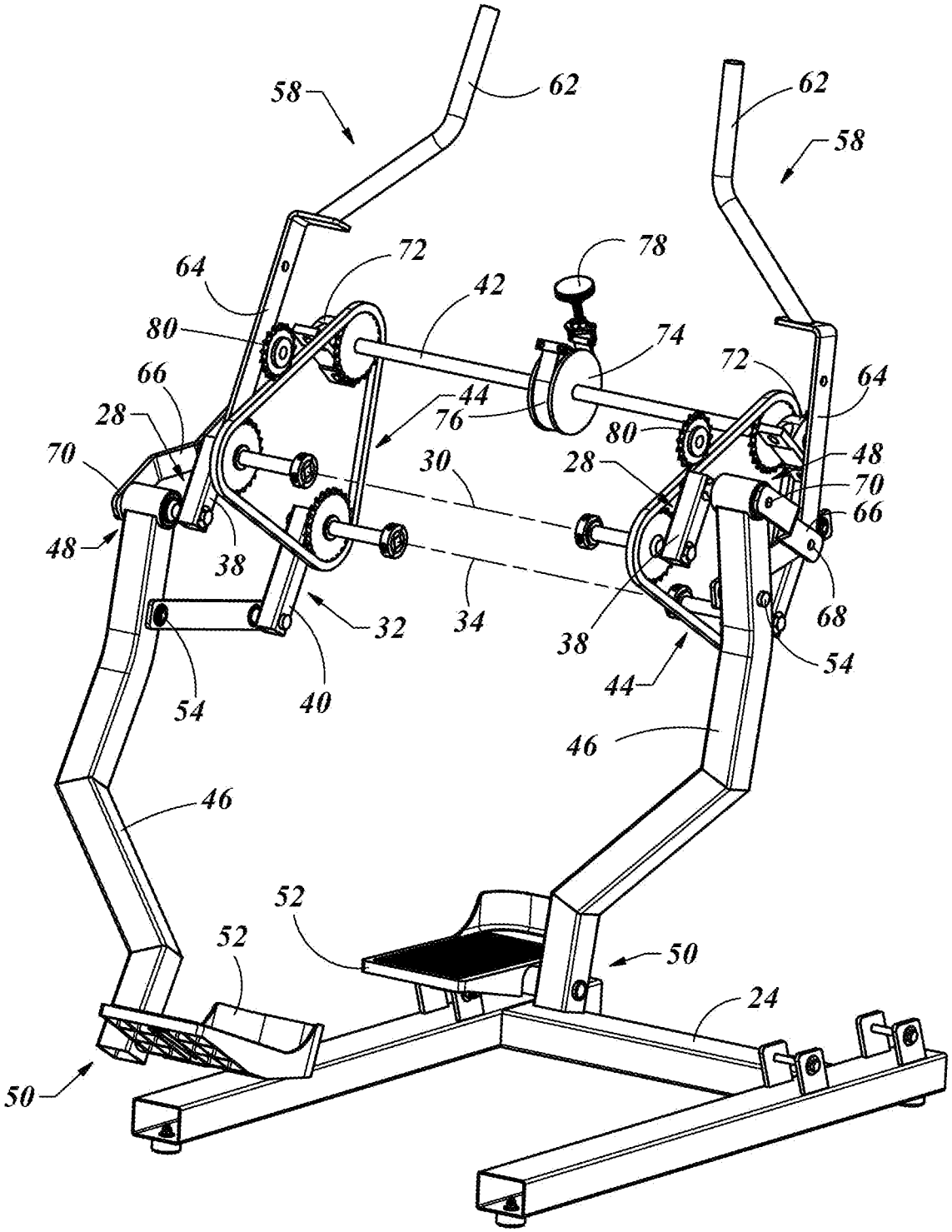
FIG. 5 is an isometric view from the right rear of the exercise device as shown in FIG. 3 with a portion of the frame removed to more clearly show detail of the system.

With particular attention to FIG. 5, the support frame 26 has been removed to better illustrate this embodiment of the present invention 20. The elements as previously shown and described are consistent with that as presented above. What may also be more clearly seen in this Figure is the potential use of a tension device to optimize the function of the control system 44. As noted, the control system 44 may include a roller chain or drive belt. It may be desirable to use an idler pulley 80 positioned relative to the drive belt or roller chain of the control system 44 so as to displace a portion of the roller chain or drive belt, thus creating proper tension in the drive belt or roller chain to optimize the function of the control system 44.

Figure 6:
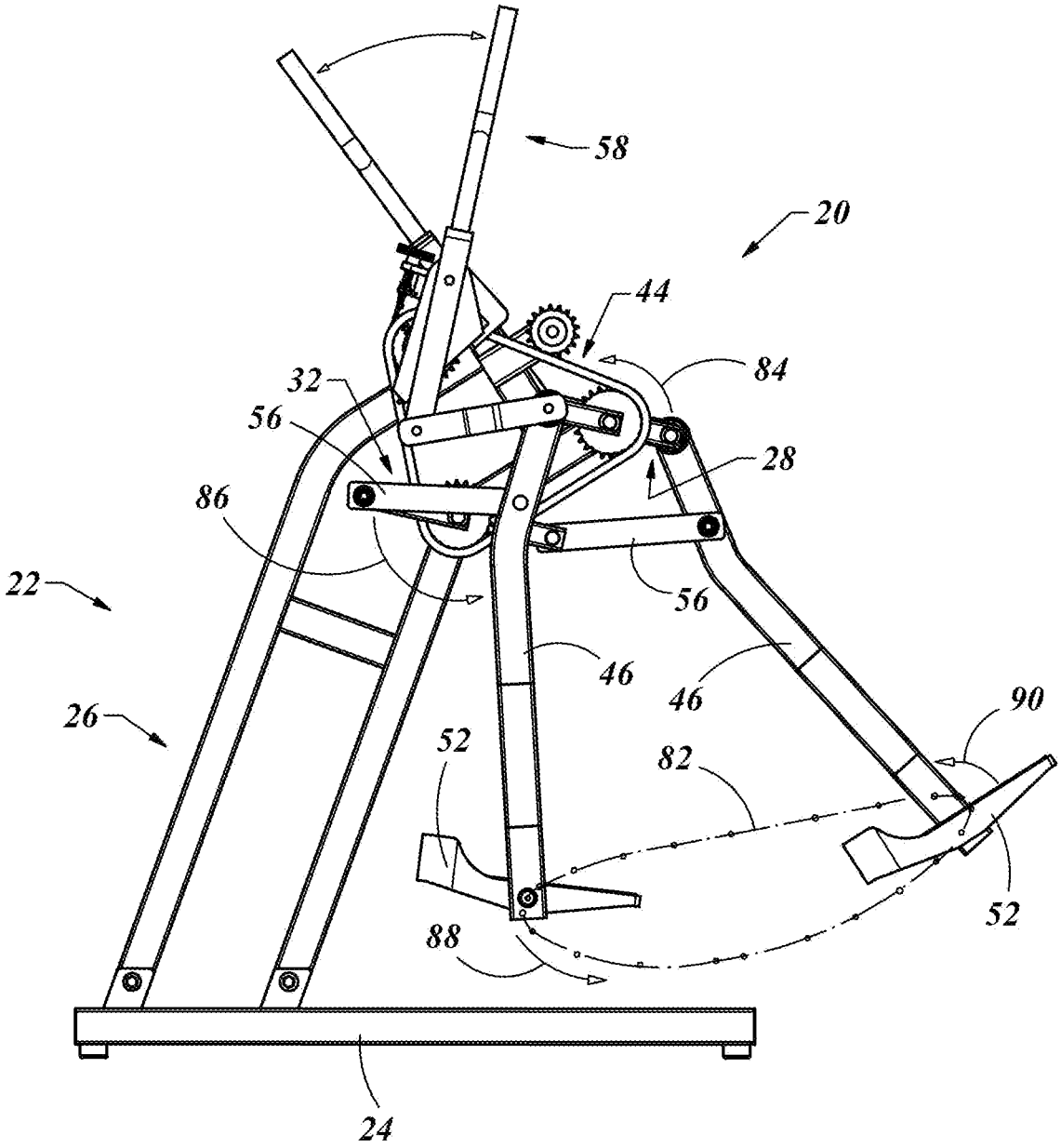
FIG. 6 is a side view of the exercise device as shown in FIG. 3 and illustrating a tracing of the movement of the pedals.

With regard to FIG. 6, a side view of the exercise device 20 is shown with a trace of a pedal path 82. In this view it can be seen how the pedal arms 46 may be connected to the first crank assembly 28. As the first crank assembly 28 rotates in the direction of the drive arrow 84 the pedal arm 46 on the left may move downward while the pedal arm 46 on the right may move upward. The control system 44 may provide the same direction of rotation of the second crank assembly 32, as designated by the second arrow 86. As the second crank assembly 32 rotates in a counter clockwise direction (in this view), the second crank assembly 32 may drive the crank link 56 to alter the angular orientation of the pedal arms 46, as they are driven by the first crank assembly 28. In this view and in this relative position of the pedal arms 46, the pedal arm 46 on the left may move generally down and to the right, as shown by the first pedal arrow 88, while the pedal arm 46 on the right may move generally up and to the right until it changes direction to move to the left and moving down as illustrated by the second pedal arrow 90. An example of a complete path of the pedals 52 may be shown moving along the trace of the pedal path 82.

It may be desirable to change the resistance of the exercise device 20. Any number of users may have different physical capabilities and therefore it may be desirable to have the exercise device conform to those varying capabilities. In addition, as a person uses an exercise device, it is likely the person's physical fitness level will improve. As such, in order to continue to make physiological gains from the exercise, it may be desirable for the exercise device to increase in its ability to stress the body of the user by increasing the workload.

Figure 7:
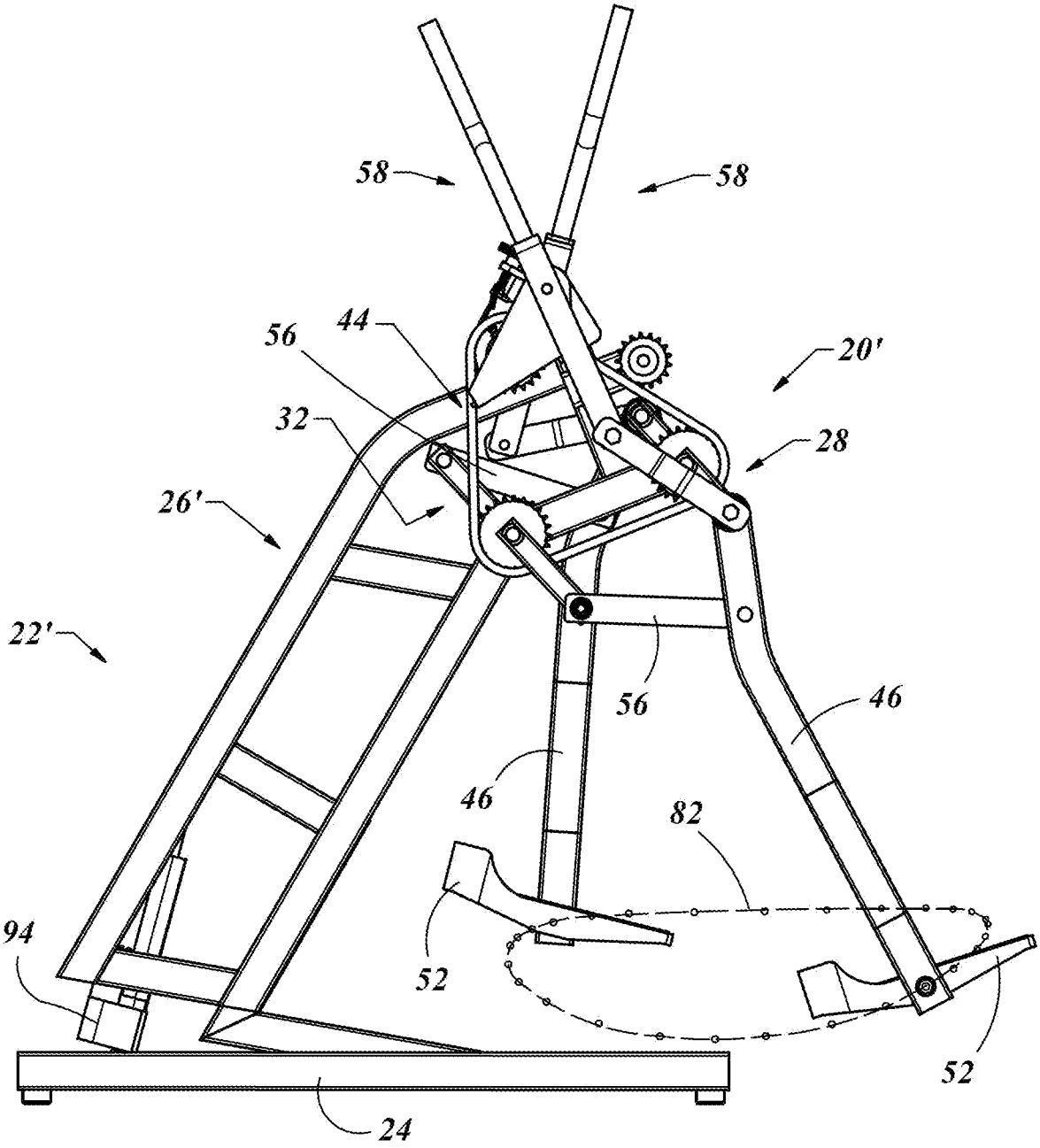
FIG. 7 is a side view of a modified version of the exercise device shown in FIG. 3, wherein the upper frame may be movably mounted to the base frame, a tracing of the pedal path at this inclined position is shown in contrast to the flat position of the upper frame in FIG. 6.
Figure 8:
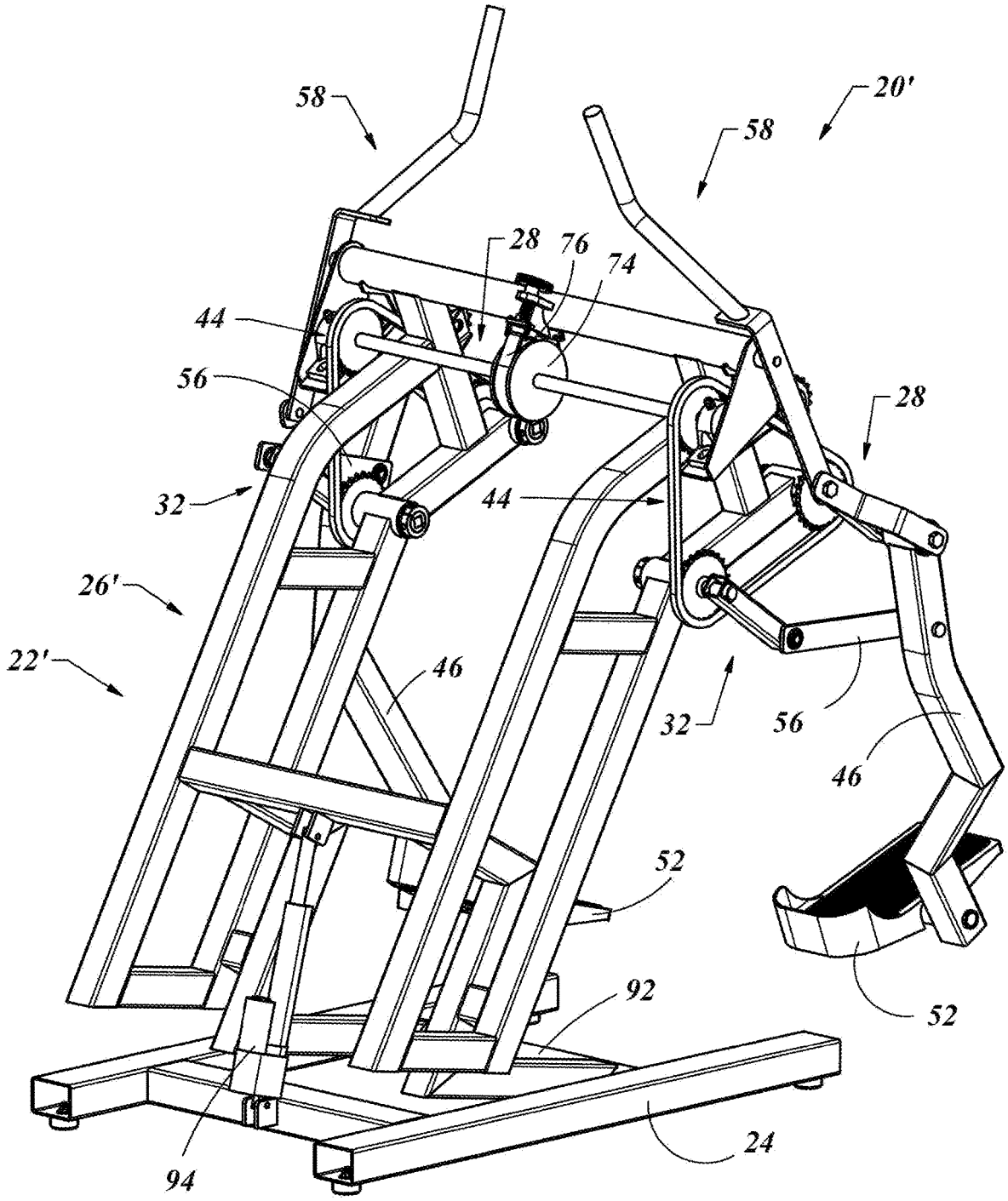
FIG. 8 is an isometric view from the front left of the exercise device shown in FIG. 7.
Figure 9:
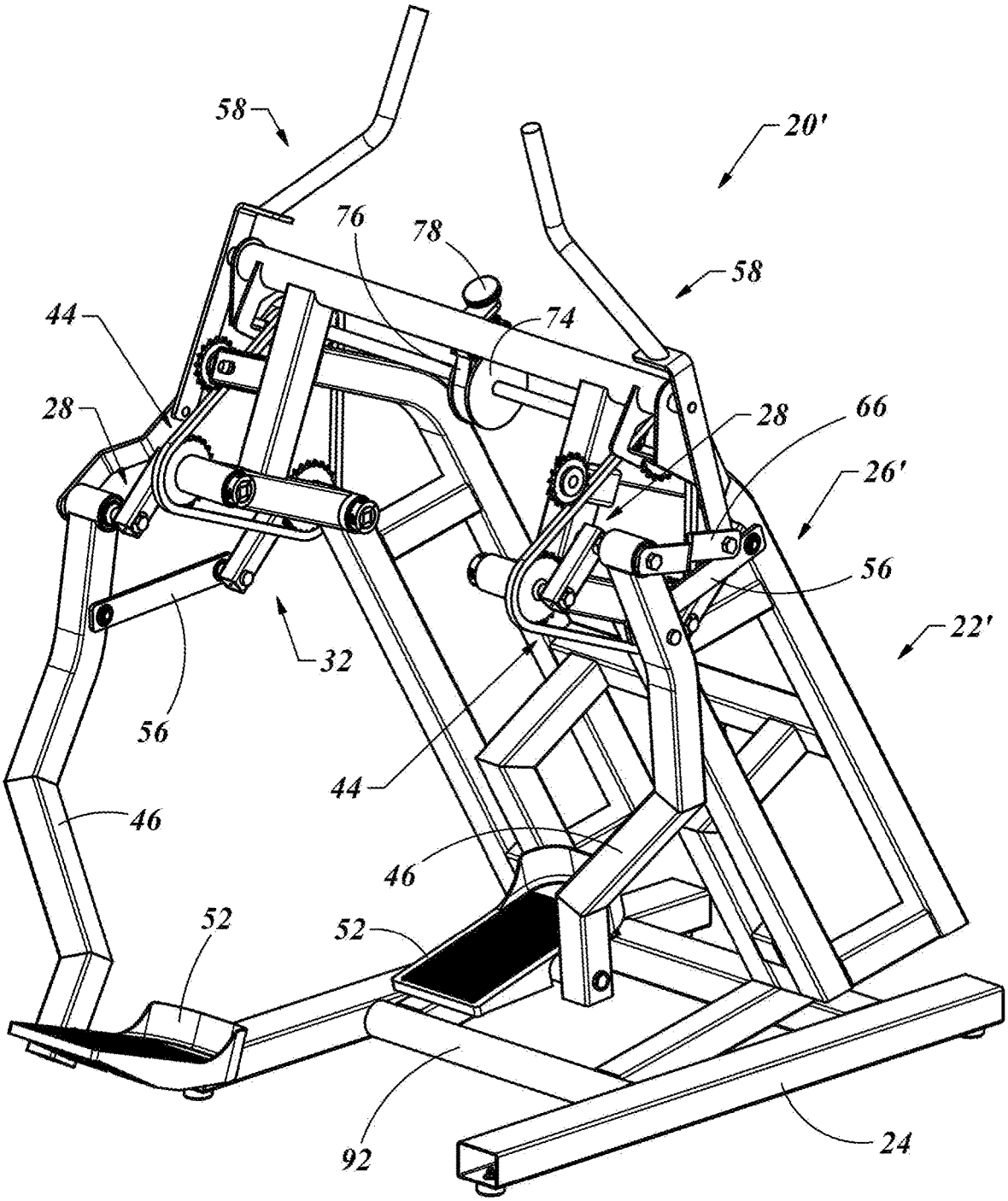
FIG. 9 is an isometric view from the right rear of the exercise device shown in FIG. 7.
Figure 10:
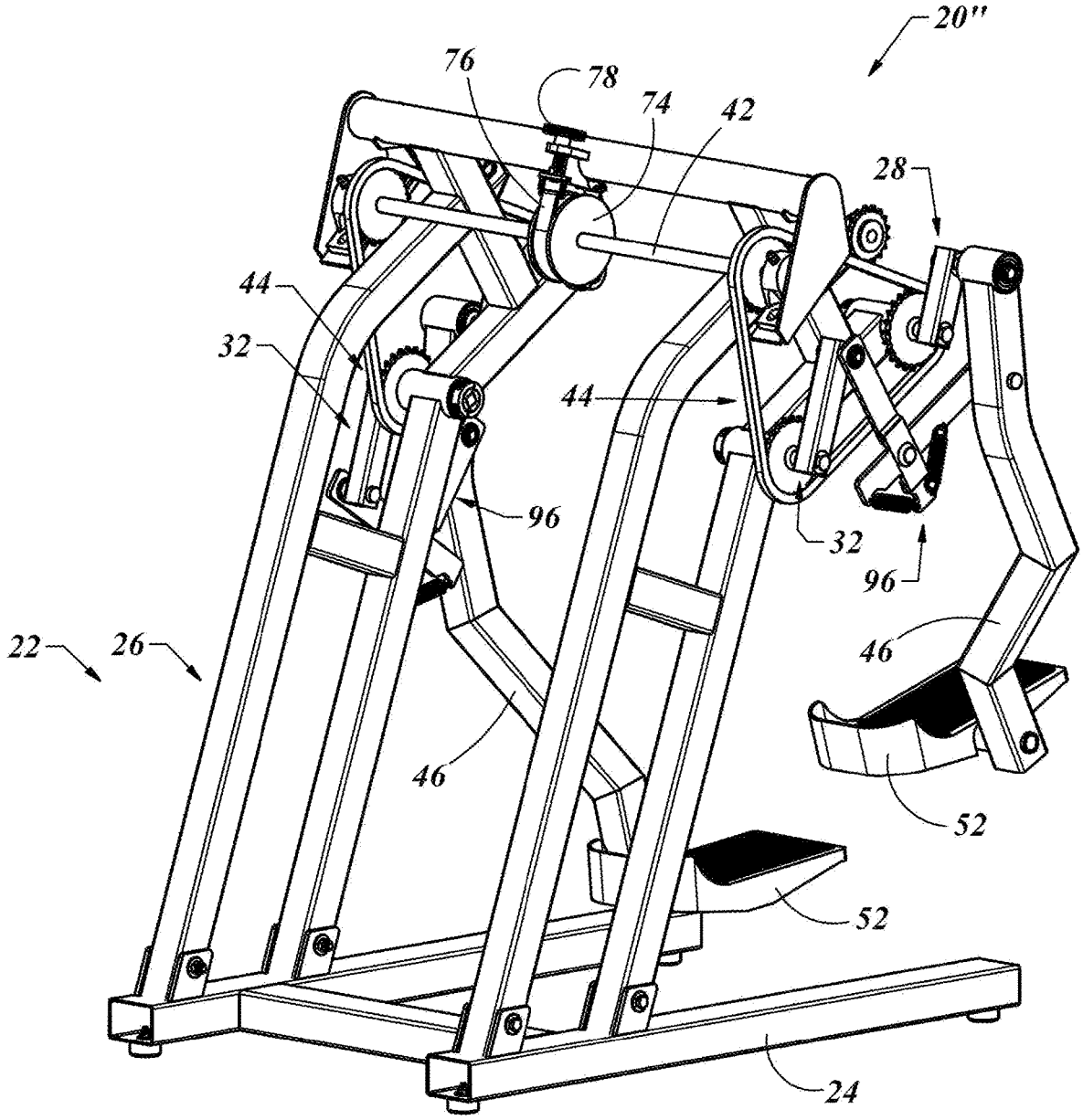
FIG. 10 is an isometric view from the left front of the exercise device as shown in FIG. 1 but where the rigid crank links have been replaced with movable crank links.
Figure 11:
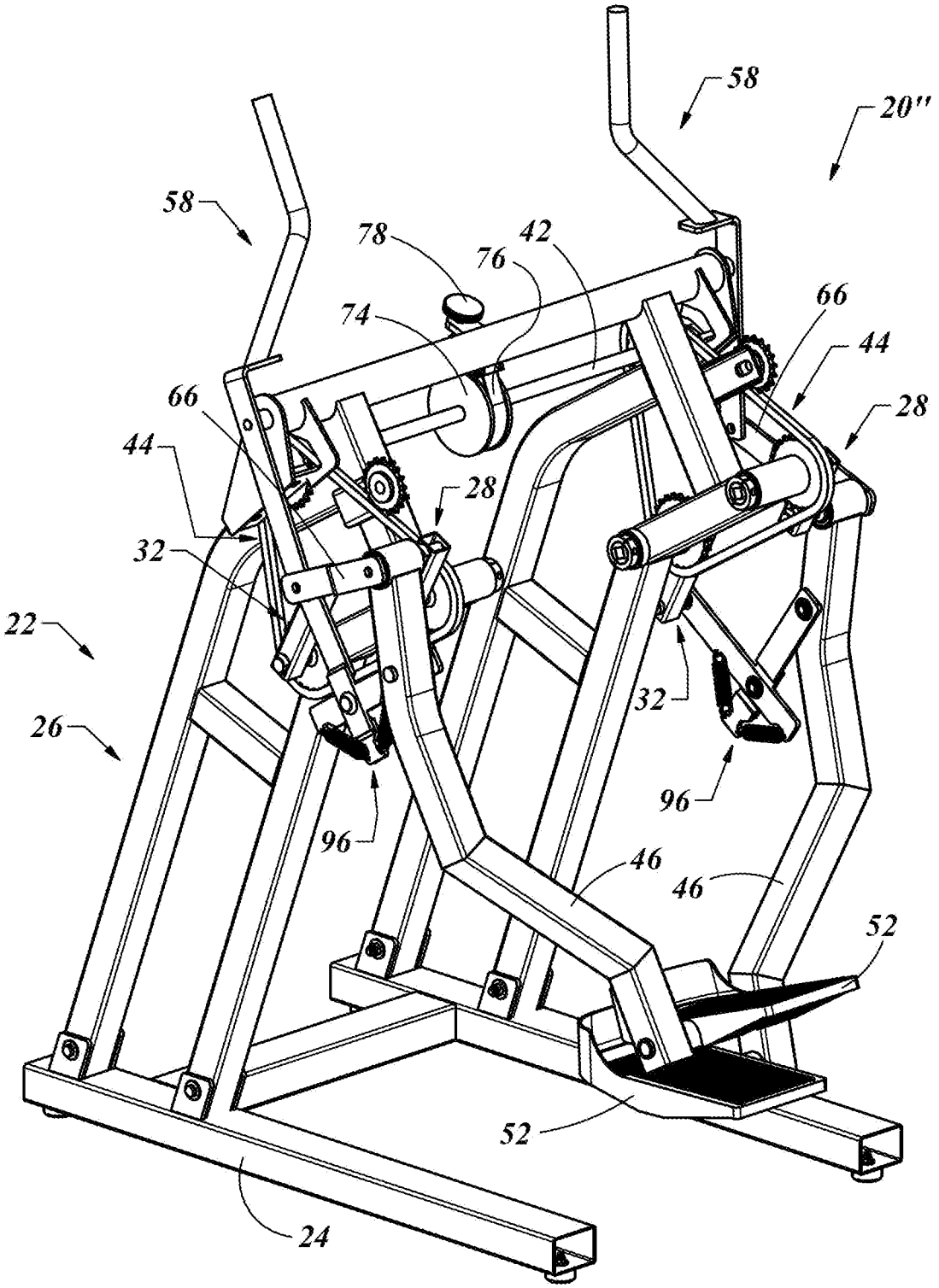
FIG. 11 is an isometric view from the left rear of the exercise device as shown FIG. 2, but where the rigid crank links have been replaced with movable crank links.

As noted, one method to increase the workload in the present exercise device 20 is by providing resistance to rotation of the flywheel 74 by way of the friction strap 76 or any other form of resistance, such as any number of electromagnetic braking systems. An alternative may be to increase the angle of the pedal path. A solution to do so is illustrated in FIGS. 7-9. As was shown in FIG. 6, the trace of the pedal path 82 may be similar to that of a normal walking gait of a person. This walking gait may be similar to that of a person walking on a treadmill with no incline. To increase the caloric expenditure the user may increase the incline or grade of the treadmill deck. According to the American College of Sports Medicine, a person walking on a flat 0% grade versus walking the same speed at a 10% grade will have an estimated metabolic requirement of over 2.3 times greater walking at the inclined grade. Therefore, changing the angle of incline of the gait pattern of the user may also increase energy expenditure of the user during the exercise session. In that a walking gait may result in significantly lower impact stress on the joints of the user, it may be desirable for a user to exercise in this manner as opposed to running and expend a similar amount of energy per unit of time performing the inclined walking exercise.

With regard to FIGS. 7-9, an alternative version of the exercise device 20' is shown which may incorporate the ability to change the angle of the pedal path of the user. The frame 22' may include the base frame 24, which may be supported on the ground or floor as with the other embodiments. The support frame 26' may include a support frame pivot 92, which may be coupled to the base frame 24. This may allow the support frame 26' to change its angular orientation with respect to the base frame 24 by pivoting about the support frame pivot 92. An actuator 94 may be positioned between the base frame 24 and the support frame 26' wherein as the actuator 94 extends, the angle between the support frame 26' and the base frame 24 may be increased. As may be illustrated in FIG. 7, the trace of the pedal path 82 may have the same overall shape as that shown in FIG. 6 where the exercise device 20 is at a standard flat position, but the trace of the pedal path 82 may be rotated in FIG. 7 in accordance with the increase in angle of the support frame 26' relative to the base frame 24. This may allow a user to increase the workload of the exercise session to a varying degree according to the amount of incline the user selects between the support frame 26' and the base frame 24.

It may be desirable to enable the user to change the stride length of the pedal path. An example of how this may be accomplished is shown in FIGS. 10-14. The general function of the exercise device 20" may be the same as previously shown and described with the exception of the crank link 56 may be replaced with a movable crank link 96. The movable crank link 96 may include a first link 98 and a second link 100, which may be pivotally coupled about a crank link pin 102. A first spring 104 may be coupled to the first link 98 and the second link 100 and in a similar but opposite manner, a second spring 106 may likewise be coupled to the first link 98 and the second link 100. The orientation of the first spring 104 and the second spring 106 may apply a balanced couple to the first link 98 relative to the second link 100 so that the distance "x" between the bearing attachments 108 may be biased to a predetermined dimension. Though the movable crank link 96 may be biased to a dimension "x" between the bearing attachments 108, if a force is applied to the movable crank link 96 in a direction to decrease the value of "x", the first spring 104 may increase in length and the second spring 106 may decrease in length.

A spring may obey "Hook's Law" in that the force needed to deform a spring by some distance is proportional to that distance. Therefore in this example, if a force is applied to cause the distance "x" to decrease, as depicted by the compression arrows 110 shown in FIG. 12, the length of the first spring 104 may increase and therefore the force applied by the spring to the first link 98 and the second link 100 would also proportionally increase. The length of the second spring 106 may decrease, and therefore the force applied to the first link 98 and the second link 100 by the second spring 106 may proportionally decrease. The opposite may be found in that as force is applied to the movable crank link 96 that results in increasing the dimension "x", as depicted by the extension arrows 112, the first spring 104 may decrease in length (and applied force) and the second spring 106 may increase in length (and applied force).

The result is the movable crank link 96 may allow for the dimension "x" to be increased or decreased by forces applied to the movable crank link 96, but the action of the first spring 104 and the second spring 106 may provide a pair of forces that may be balanced optimally when the dimension "x" is at a predetermined value. This combination may allow for displacement of the first link 98 relative to the second link 100 of the movable crank link 96 to allow the value of "x" to vary, but yet provide a bias to return the orientation of the movable crank link 96 to that so the dimension "x" may be a predetermined value.

Figure 12:
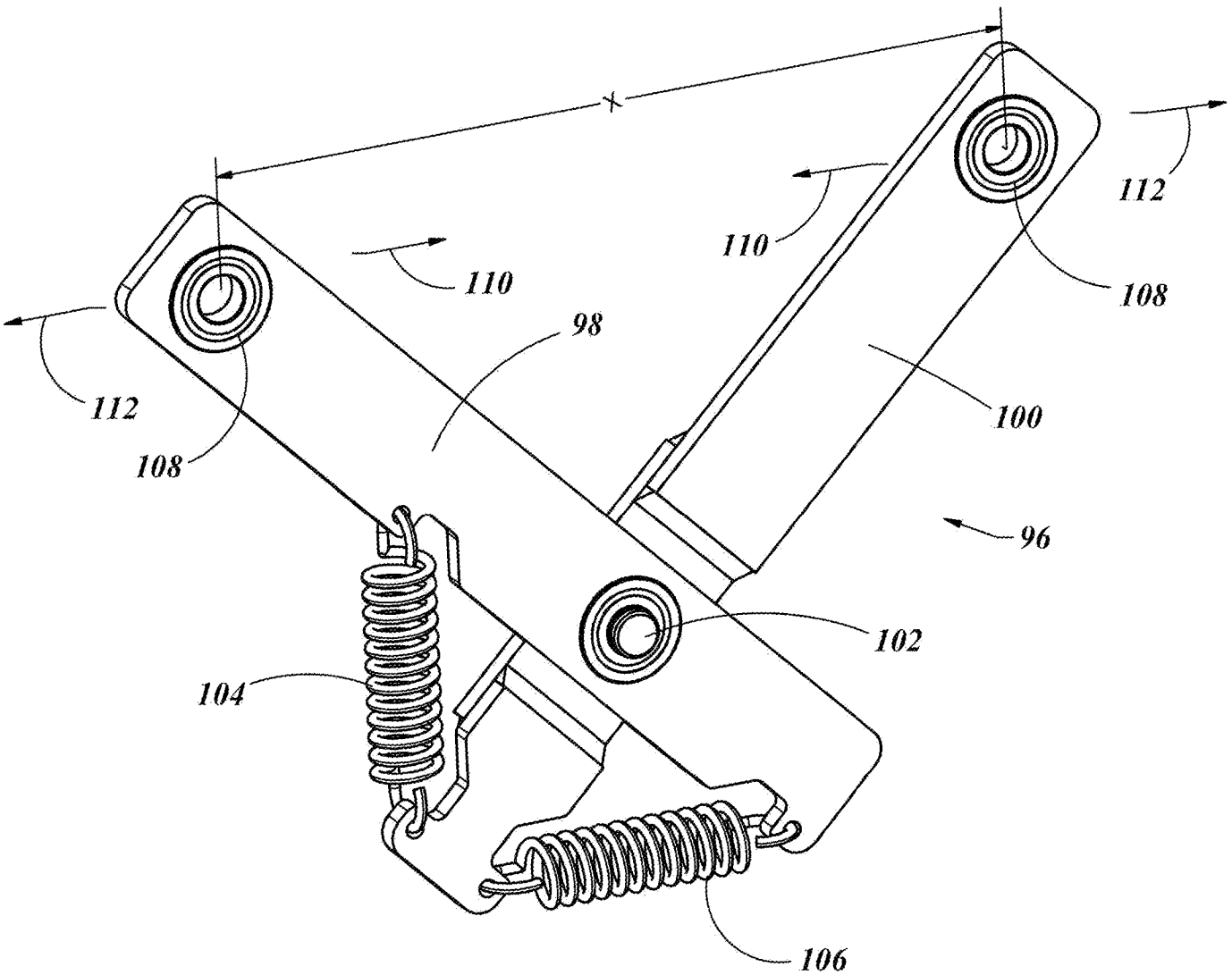
FIG. 12 is an isometric view of a movable crank link removed from the rest of the exercise device as shown in FIG. 11.
Figure 13:
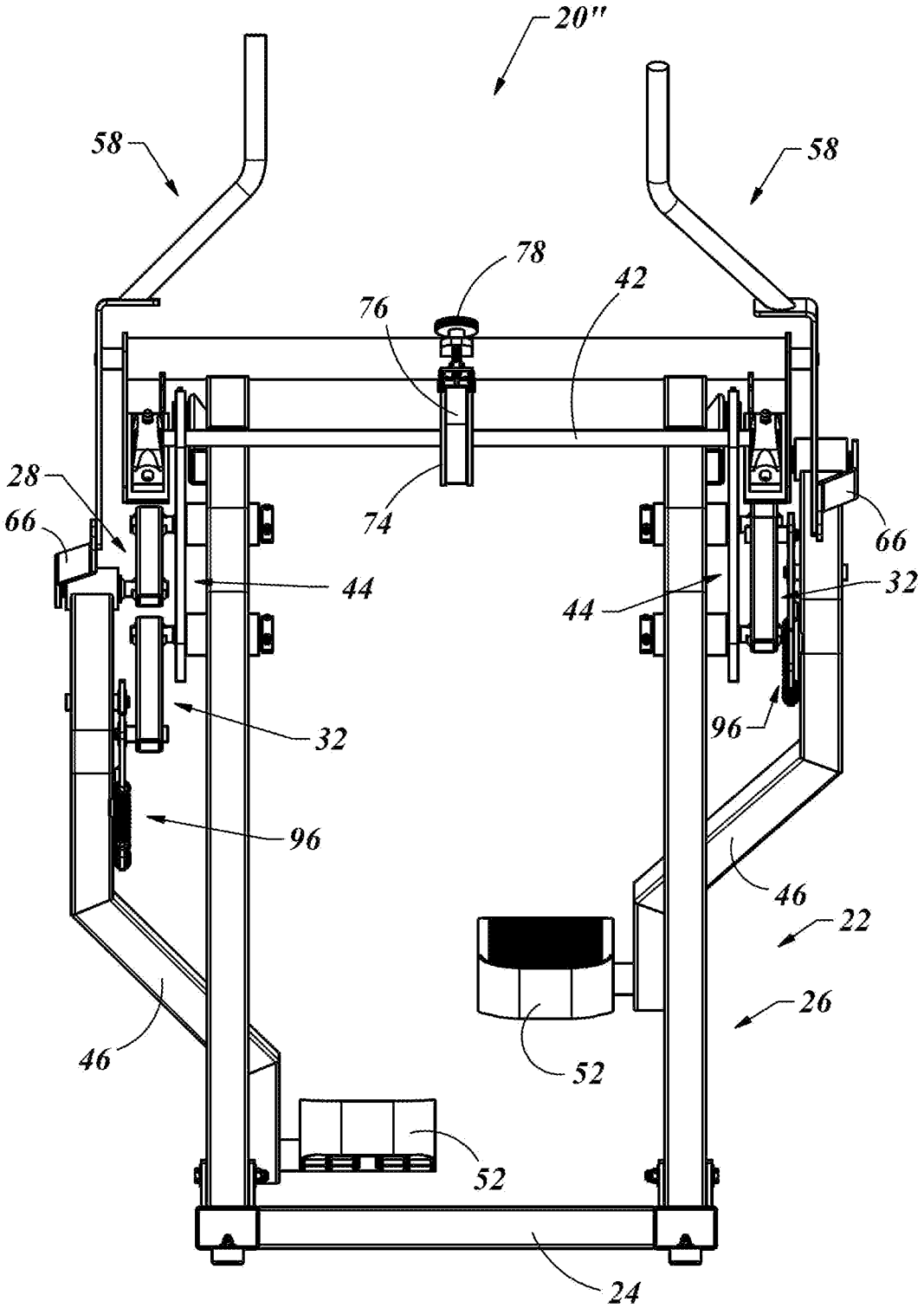
FIG. 13 is a front view of the exercise device as shown in FIG. 11.
Figure 14:
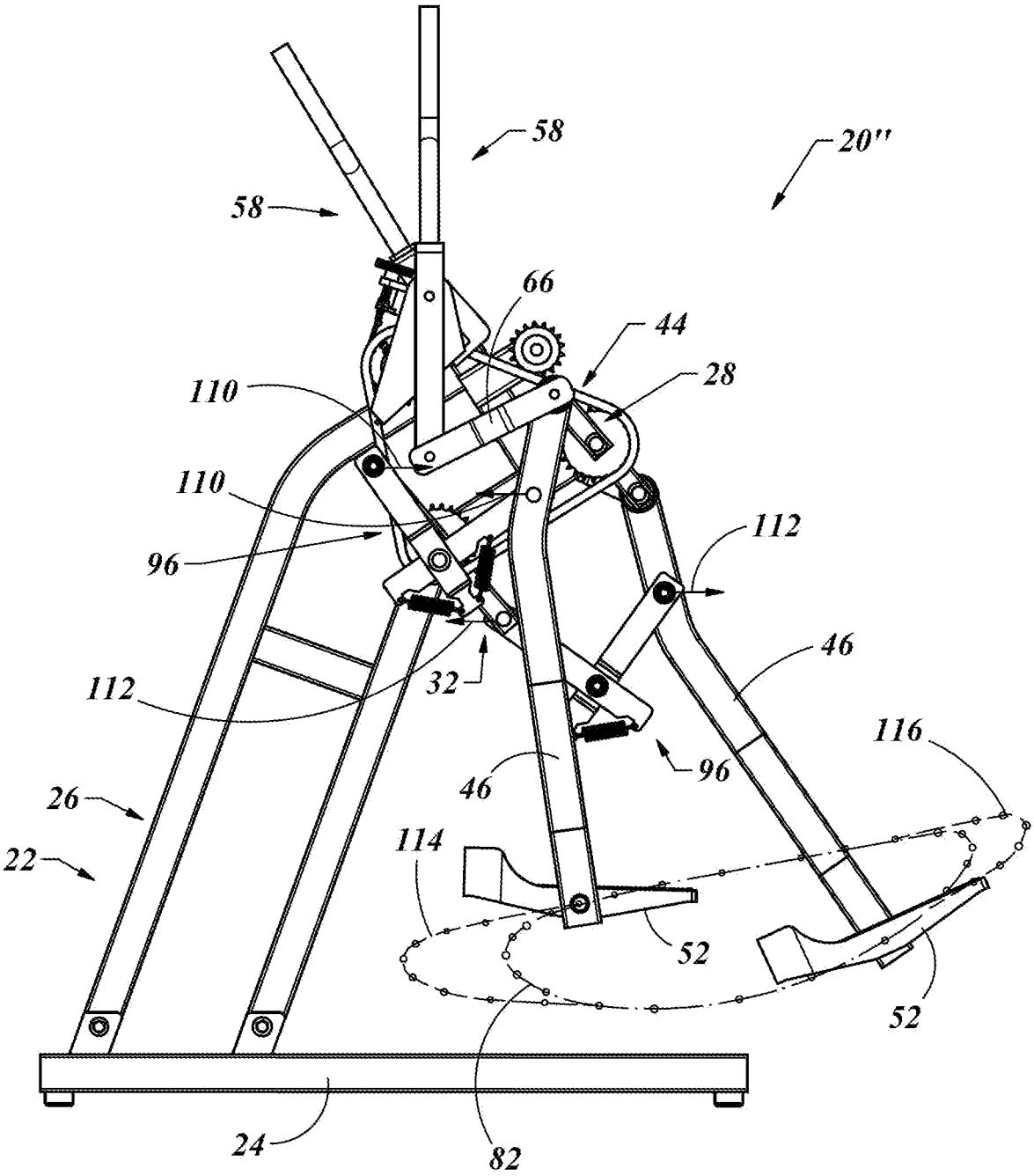
FIG. 14 is a side view of the exercise device as shown in FIG. 11 illustrating the tracing of the pedal paths of the movable crank links in a neutral position and also as may be seen when the movable crank links are moved by the user.

When used on the exercise device 20", the force applied to the movable crank links 96 may be applied by the user to the pedals 52. This may be illustrated in more detail in FIG. 14, where the previously illustrated trace of the pedal path 82 is presented as it may be generated if the movable crank links 96 maintain a set angular orientation of the first link 98 relative to the second link 100, so as to provide a constant dimension "x", as shown in FIG. 12. If the user provides a force to the forward pedal 52 (left one pedal in FIG. 14) to extend it forward beyond the trace of the pedal path 82, a force may be applied to the movable crank link 96 coupled to the forward pedal arm 46 (left one in FIG. 14) to provide a force to move the movable crank link 96 in the direction of the compression arrows 110, or to reduce the value of dimension "x". This may allow the pedal 52 supporting the front foot to extend beyond the trace of the pedal path 82 on the forward pedal 52 (left in FIG. 14) to generate a front pedal path trace extension 114.

In a similar but opposite manner, if the user wishes to extend the pedal 52 supporting the back foot farther back than what may be illustrated by the trace of the pedal path 82, the user may apply a force to the rear pedal 52, (right one in FIG. 14) which may cause the movable crank link 96 connected to the pedal arm 46 supporting the rear pedal 52 (right one in FIG. 14) to move in the direction of the extension arrows 112, or to increase the value of dimension "x". This may allow the pedal 52 supporting the rear foot to extend beyond the trace of the pedal path 82 on the rear pedal 52 (right one in FIG. 14) to generate a rear pedal path trace extension 116. The combination may provide an increased stride length of the pedals 52, which may accommodate a taller person, or anyone else that may want a longer stride length. This may be accomplished by the user overcoming the resistance provided by the first spring 104 and the second spring 106 as needed and to the extent desired by the user.

Figure 15:
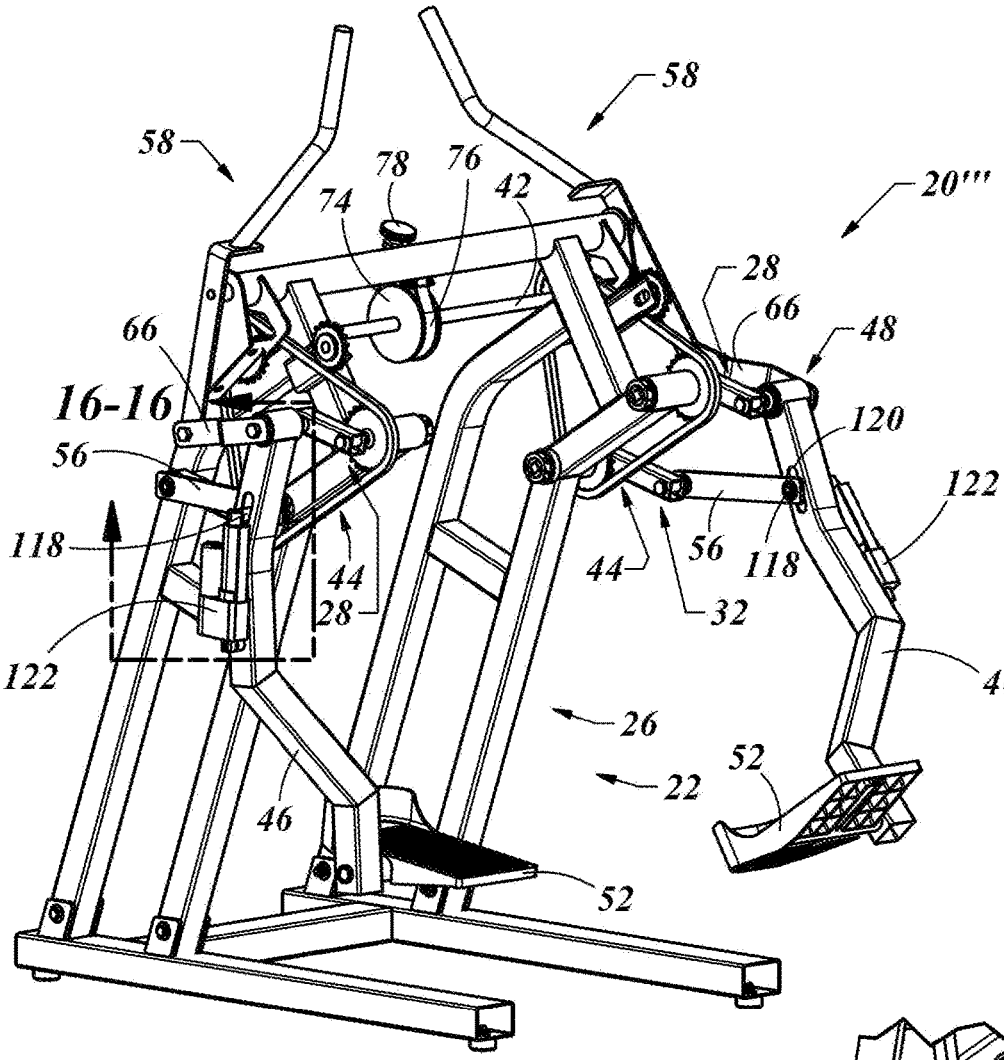
FIG. 15 is an isometric view from the left rear of an exercise device produced in accordance with the present invention in which the crank link pin is movably mounted on the pedal arm.
Figure 16:
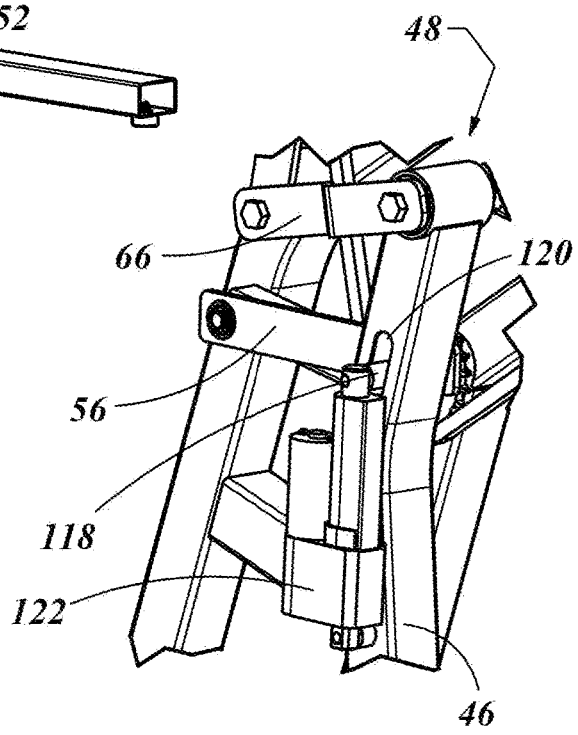
FIG. 16 is a detailed view of the crank link pin and pedal arm as shown in FIG. 15, the view cut along the line 16-16 in FIG. 15.
Figure 17:
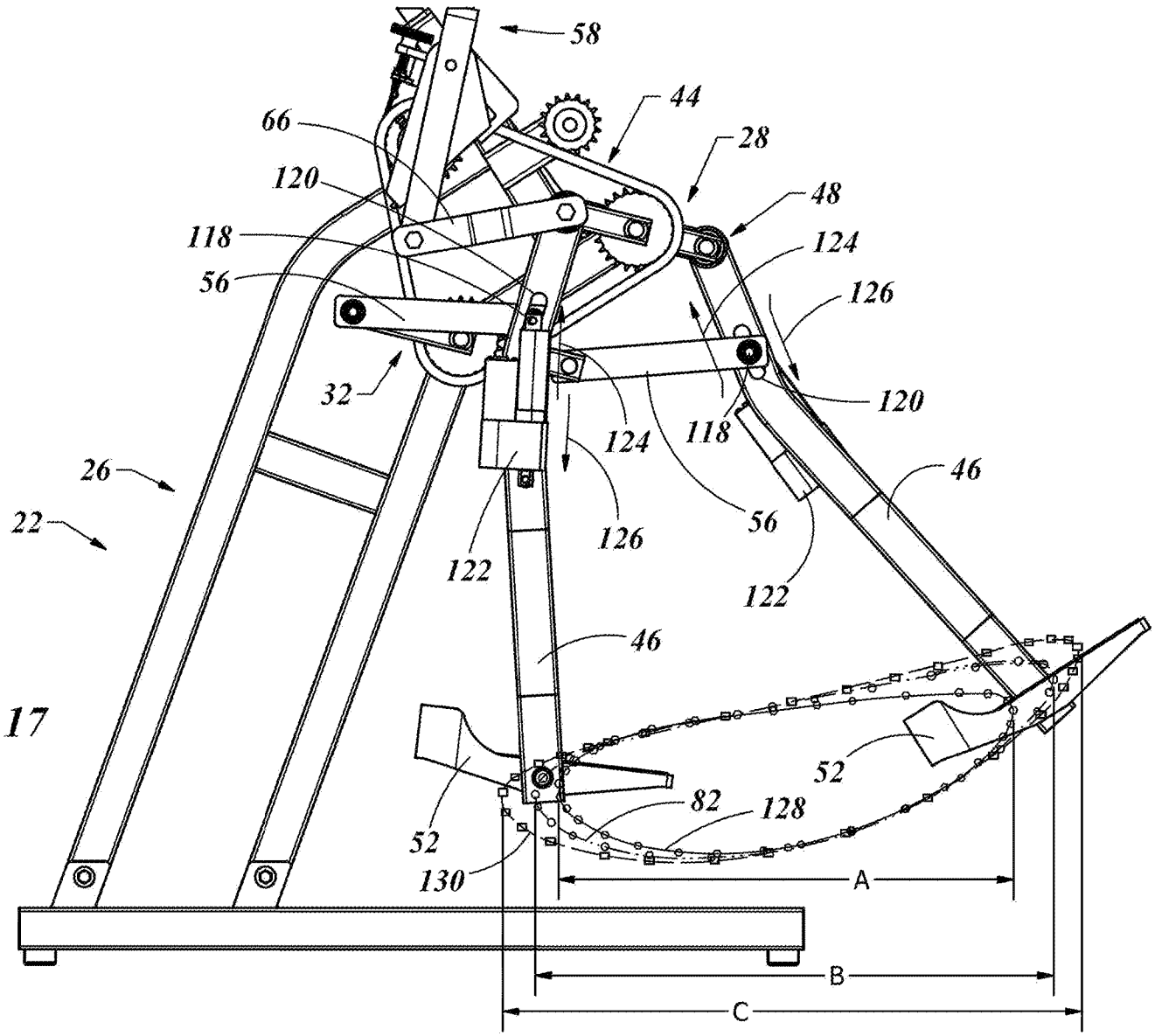
FIG. 17 is a side view of the exercise device as shown in FIG. 15 including the tracing of the pedals as altered by the movement of the crank link pin on the pedal arm.
Figure 18:
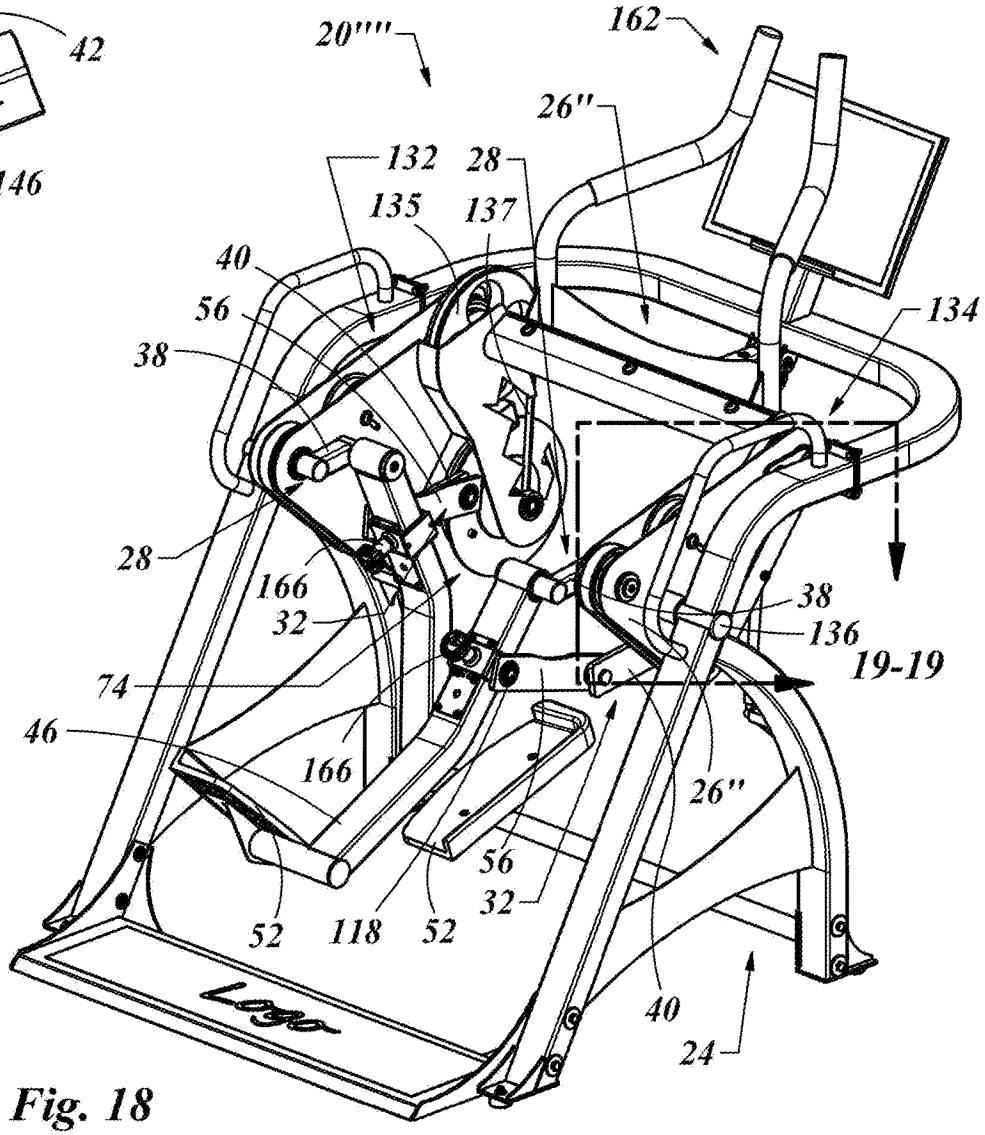
FIG. 18 is an isometric view of an alternative embodiment of the exercise device as shown in FIG. 1.
Figure 19:
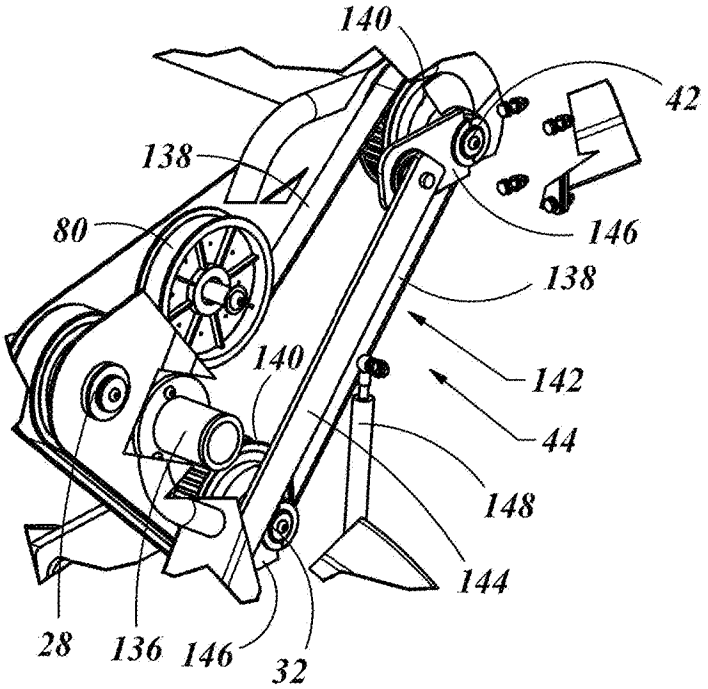
FIG. 19 is a detail cut away of the support frame and transmission of the exercise device of FIG. 18, cut along line 19-19.
Figure 20:
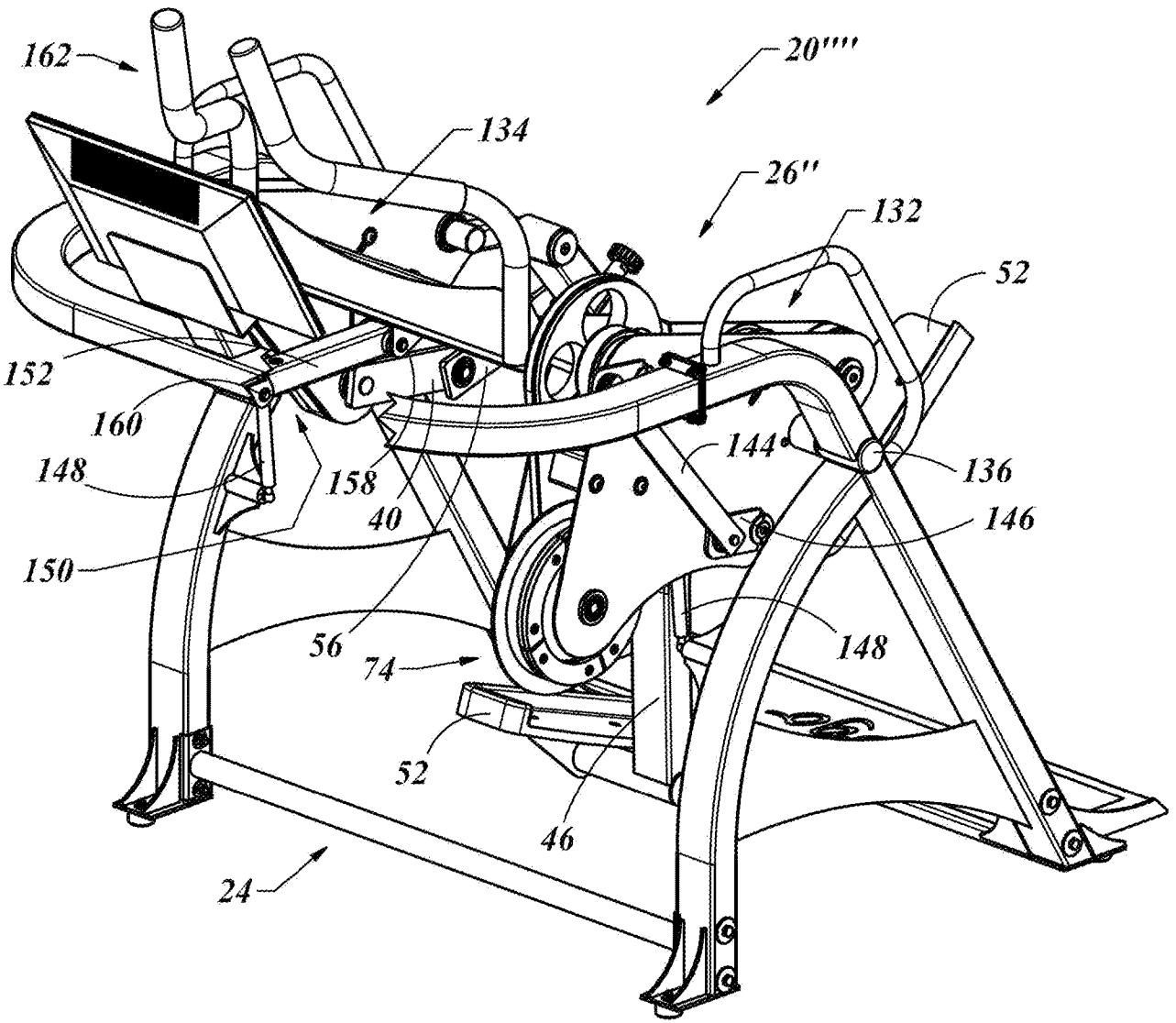
FIG. 20 is an isometric view of the exercise device of FIG. 18, shown from a front, side perspective with a portion of the base frame removed.

Another option to vary the stride length of the pedals 52 is presented in FIGS. 15-17. In this embodiment of the exercise device 20'" the crank link 56 may be used, or the movable crank link 96 as disclosed previously. As previously noted, the movable crank link 96 may enable a system in which the user may alter the stride length by simply using a longer stride length in their gait and the exercise device 20" may conform to the user's foot path of travel. In FIGS. 15-17 a system is illustrated which may provide a set stride length that is adjustable. It is possible to use both the movable crank link 96 as disclosed with the adjustable system illustrated in FIGS. 15-17. That combination is not shown though it is understood that this combination is inherently part of this disclosure.

With regard to FIGS. 15-17, an exercise device 20'" is shown in which the crank link pin 54 of the previous embodiments may be replaced with a movable link pin 118. The movable link pin 118 may be slidably or pivotally mounted to the pedal arm 46. It is shown to be received by a slot 120 in the pedal arm 46, but this slot 120 is not critical. The movable link pin 118 may be mounted to the linear slide, or pivotally coupled to the pedal arm 46, in any way that is known in the art, so that a controlled movement of the movable link pin 118 may be provided. An actuator 122 may be used to move the movable link pin 118 on the pedal arm 46 closer to, or further from, the first end 48 of the pedal arm 46. If the movable link pin 118 is moved up closer to the first end 48 of the pedal arm 46, as illustrated by the up arrows 124, the stride length of the pedal 52 may be increased. If the movable link pin 118 is moved down, farther from the first end 48 of the pedal arm 46, as illustrated by the down arrows 126, the stride length of the pedal 52 may be decreased. This adjustment of the relative position of the movable link pin 118 as moved by the actuator 122 may be adjusted by the user before an exercise session begins or with a system that may be powered, such as with the actuator 122, the adjustment may be also accomplished while the user is performing the exercise. A simple screw adjustment or even a movable but locking movable link pin 118 system may be used where the user may adjust and lock the movable link pin 118 in a set position prior to beginning the exercise session.

The horizontal displacement of multiple stride lengths of the pedals 52 that may be provided by varying the position of the movable link pin 118 is illustrated in FIG. 17. The trace of the pedal path 82, as previously presented, may be shown as a midpoint of the location of the movable link pin 118. This may provide a horizontal dimension of the trace of the pedal path 82 as identified by the value "B". If the movable link pin 118 is moved in accordance with the down arrows 126, thereby increasing the distance between the movable link pin 118 and the first end 48 of the pedal arm 46, a shorter pedal path 128 may result. The shorter pedal path 128 may be associated with a smaller horizontal displacement identified as "A". If the movable link pin 118 is moved closer to the first end 48 of the pedal arms 46, as noted by the up arrows 124, a greater stride length may result. The longer pedal path 130 may be associated with the greater horizontal displacement identified as "C".

If the movable link pin 118 is used with a constant length crank link 56, as shown, the adjustment in the stride length may provide a series of set pedal paths (82, 128, 130) or any infinite number of variations to those shown. Each path may be a result of the settings of the exercise device 20'" and therefore stable to the user, as the user may not be able to alter the pedal paths without making an adjustment to the position of the movable link pin 118. This stability may be desirable to some users in that their body may be fully supported on the pedals 52 of the exercise device 20'". Using the movable crank link 96 with the adjustable stride length system as provided by the movable link pin 118 together may provide a system which allows for the user to vary their stride length where the path of the pedals 52 comply with that of the user, and an adjustable baseline path of the path of the pedals 52 may be provided by the movable link pin 118 and set in accordance with the desire or some physical characteristics of the user.

Another embodiment of the exercise device 20"" is shown in FIGS. 18-23. With attention to FIGS. 18-20, the support frame 26" may be comprised of first drive 132 and a second drive 134, each coupled to the support frame 26". The support frame 26" may be movably coupled to the base frame 24 by way of a pivot joint 136. The first drive 132 and the second drive 134 may be positioned such that a person may position themselves between the first drive 132 and the second drive 134. The support frame 26" may also support the drive shaft 42, which may be in mechanical communication with the flywheel 74. The first drive 132 and the second drive 134 may each support a first crank assembly 28 and a second crank assembly 32 in such a manner such that the first crank arm 38 of the first crank assembly 28, coupled to the first drive 132 may be one hundred and eighty degrees out of phase from the first crank arm 38 of the first crank assembly 28, coupled to the second drive 134. In a similar manner, the second crank assembly 32 may include a second crank arm 40 coupled to the first drive 132 that may be one hundred and eighty degrees out of phase from the second crank arm 40, coupled to the second drive 134. The first crank arm 38 and the second crank arm 40 may be parallel to each other on both the first drive 132 and the second drive 134.

A drive pulley 135 may be mounted to the drive shaft 42. The drive pulley 135 may be in mechanical communication with the flywheel 74 by way of a drive belt 137. A braking system may be coupled to the flywheel 74 so that resistance provided to the flywheel 74 may offer a resistance to movement of the drive shaft 42, which in turn may offer a resistance to movement of the pedals 52. This combination may offer a form of exercise resistance to the user.

The control system 44 may include a drive member 138, which may take the form of a belt, roller chain, a synchronous belt, a v-belt, a poly-v belt or any other power transmission system known in the art. The drive member 138, as shown here in the form of a belt, may be tensioned by the idler 80. A drive pulley 140 may be secured to the first crank assembly 28 and the second crank assembly 32 on both the first drive 132 and the second drive 134. The drive member 138 may be limited to a belt or other power transmission system alone. Alternatively it may be advantageous to provide a secondary power transmission system in the form of a torque linkage 142. This may include a link rod 144 that may be coupled to the second crank assembly 32 and the drive shaft 42 by way of a pair of clamp links 146. This torque linkage 142 may be used to supplement the drive member 138 when high torque is applied to the second crank assembly 32 by the user. The braking system may be applied to the flywheel 74, as such, the highest load may be seen between the second crank assembly 32 and the drive shaft 42. The use of the torque linkage 142 may allow the drive member 138 to be designed for the lower torque associated with extended use by a user and when high forces are applied by the user, such as during sprinting or high incline "hiking" movements, the torque linkage 142 may supplement the power transmission, taking any excessive stress off the drive member 138. This may help eliminate the possibility of drive member 138 jumping a tooth of one of the drive pulleys 140 without the need to over engineer the drive member 138 and drive pulleys 140 for stresses that are only seen occasionally and for short durations.

The torque linkage 142 is shown here to connect the second crank assembly 32 to the drive shaft 42, which may be connected to the braking system. This combination may experience the highest forces and that is why it is shown in this configuration. It is understood that one or more torque linkages 142 may connect any one or more combinations between the first crank assembly 28, the second crank assembly 32 and the drive shaft 42.

Figure 22:
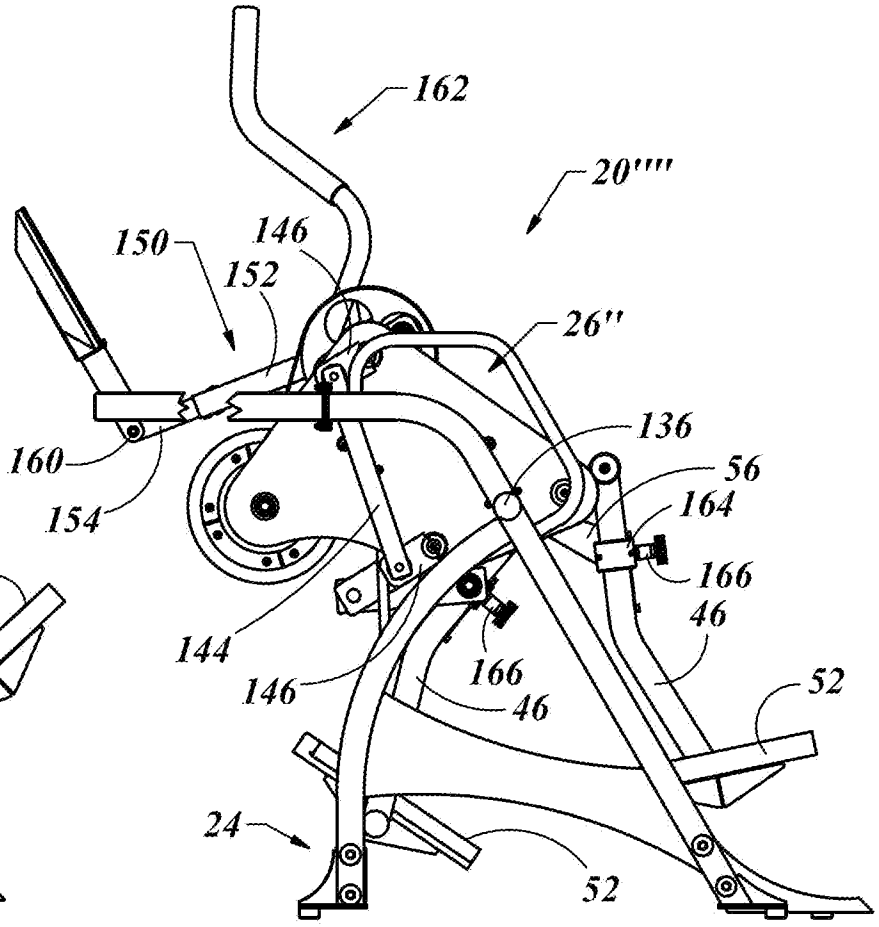
FIG. 22 is a side view of the exercise device of FIG. 21, shown in an inclined orientation.
Figure 21:
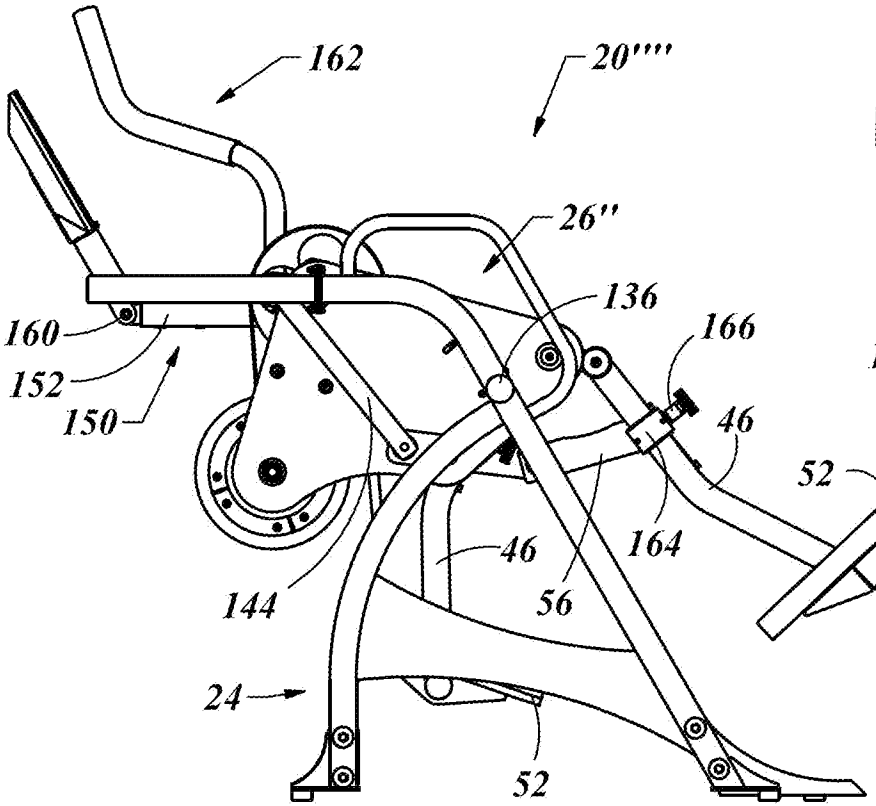
FIG. 21 is a side view of the exercise device of FIG. 18 shown in a non-inclined orientation.
Figure 23:
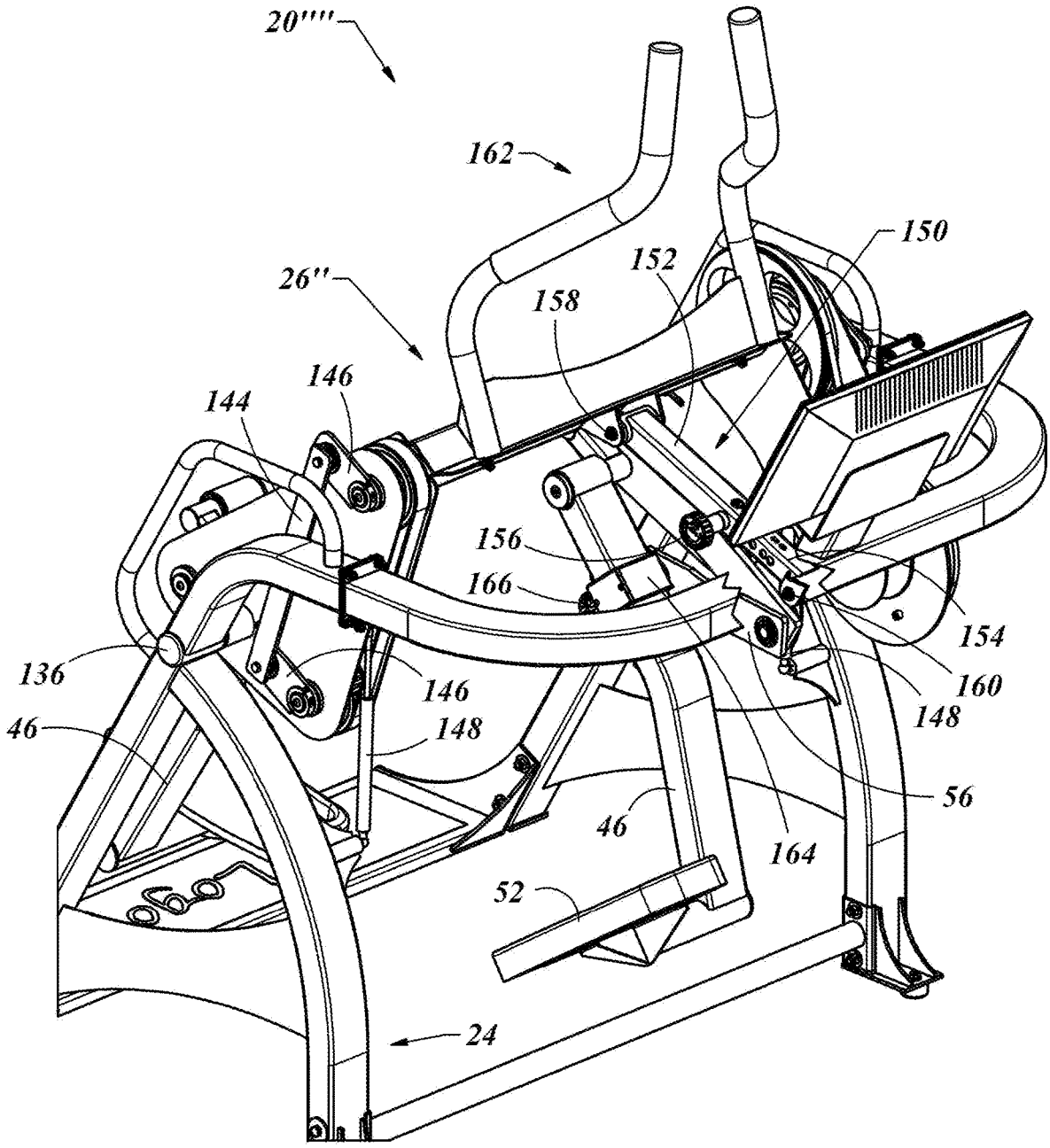
FIG. 23 is an isometric view of a portion of the exercise device of FIG. 22, shown from a front, side perspective with a section of the base frame removed.

The transfer of the higher forces that may be added by the user to the torque linkage 142 may be generated by the user by positioning the exercise device 20"" in a configuration so as to simulate walking up a hill. In this embodiment, this may be accomplished by altering the position of the support frame 26" and all the elements supported by the support frame 26" with respect to the base frame 24. One method of doing this is illustrated in FIGS. 21-23. The support frame 26" may be pivotally coupled to the base frame 24 about the pivot joint 136. One or more counterbalance springs 148 may be coupled to the support frame 26" and to the base frame 24 to counter any torque the support frame 26" may provide at rest about the pivot joint 136 due to the weight of the support frame 26" and the other elements coupled to the support frame 26". This counterbalance spring 148 may be in the form of a gas spring. An actuator, such as a linear screw actuator, may be substituted for one or both of the counterbalance springs 148 shown here. In that embodiment, the actuator may drive the front portion of the support frame 26" up or down and thereby change the angular orientation of the support frame 26" relative to the base frame 24. By changing this orientation, the pedal path, as shown in previous Figures, may also change, as inclining the front of the support frame 26" up may cause the pedal path to simulate walking up a hill.

To reduce production costs, compared to using linear actuators in place of the counterbalance springs 148, the gas springs may be used as the counterbalance springs 148 with an incline adjustment 150. The incline adjustment 150 may include a first support 152, which may articulate with a second support 154, and a locking pin 156 to releasably secure the first support 152 to the second support 154 at desired positions. This may securely alter the dimension between a support frame pin 158 and a base frame pin 160. By increasing the dimension between the support frame pin 158 and the base frame pin 160, exercise device 20"" may produce an inclined pedal angle from flat (as shown in FIG. 21) to an inclined position (as shown in FIG. 22). The user may disengage the locking pin 156, move the support frame 26" to a desired position, being aided by the counterbalance springs 148, and then engaging the locking pin 158 to secure the support frame 26" and therefore the first drive 132 and the second drive 134, to a desired level of incline.

In this embodiment the drive handles 58 of previous embodiments have been removed and a set of stationary leaning handles 162 are shown. These handle types are not mutually exclusive to any embodiment. The leaning handles 162 may be desirable in some angular orientations of the exercise device 20 and the moving drive handles 58 may be desirable in other orientations, or as a personal preference in any orientation. Either form of handles (moving drive handles 58 or stationary leaning handles 162) may be interchangeably used or in combination together on any embodiment.

A method of altering the pedal path by varying the position of the crank link 56 on the pedal arm 46 has been disclosed. This embodiment of the exercise device 20"" illustrates a manually adjustable version to accomplish this task. An adjustment bracket 164 may be releasably secured to the pedal arm 46 at one or more positions on the pedal arm 46. A leg lock pin 166 may be used to releasably secure the adjustment bracket 164 to a position on the pedal arm 46. The crank link 56 may be pivotally secured to the adjustment bracket 164 at the movable lock pin 118, and as noted before, also to the second crank arm 40. Therefore, by adjusting and securing the adjustment bracket 164 at different positions on the pedal arm 46, the path of the pedals 52 may be altered to achieve more than one pedal path, as previously disclosed.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

Figure 24:
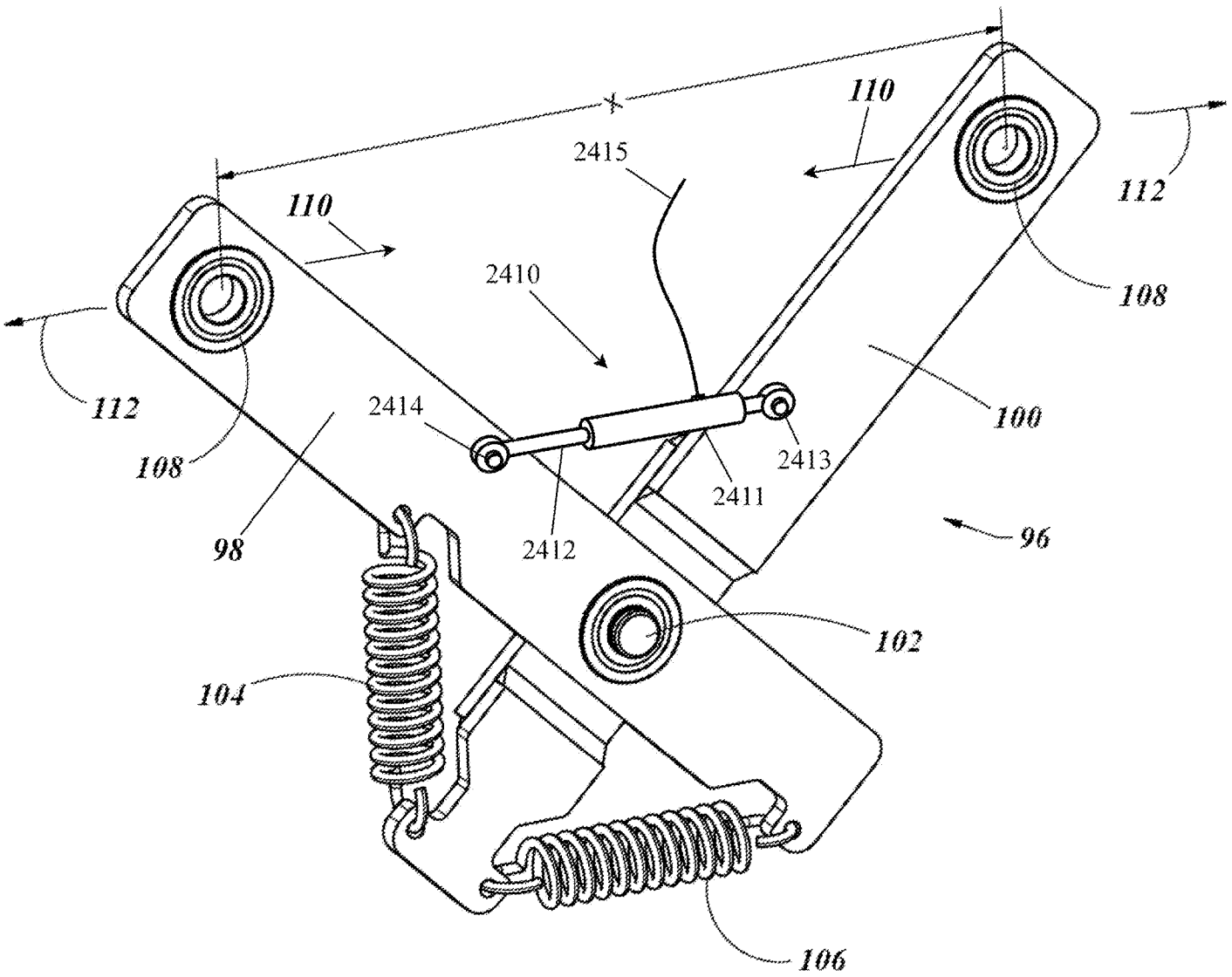
FIG. 24 is a diagram illustrating an exemplary sensor for detecting movement of a movable crank link.

FIG. 24 is a diagram illustrating an exemplary sensor for detecting movement of a movable crank link. Movable crank link 96 shown in this diagram is the same as that shown and described for FIG. 12, but with the addition of a linear position sensor 2410 to provide data regarding the amount of movement of movable crank link 96 during operation. Linear position sensor may be of any suitable type including, but not limited to, analog or digital type, resistive type, inductive type, and variable differential transformer type. Linear position sensor of this embodiment comprises a body 2411 comprising a fixed operational sensor component (e.g., a resistor coil or an inductive coil) and a traveling arm 2412 comprising movable operational sensor component (e.g., an electrical contact for causing an electrical connection along the resistor coil or a magnet for causing an induction in the inductive coil). Body 2411 is affixed to one link 100 of movable crank link 96 via pivoting attachment 2413 and traveling arm 2412 is affixed to the other crank link 98 via a pivoting attachment 2414. Compression of the ends of movable crank link 96 in the direction shown at 110 or elongation of the ends of movable crank link 96 in the direction shown at 112 will cause traveling arm 2412 to push into, or pull out of, body 2411, causing a position signal to be transmitted via wires 2415 to an appropriate computing device for data capture, storage, and use. As the mechanical characteristics of exercise machine are known (e.g., lengths, attachment points, and attachment angles, of crank links 98, 100, crank arms 38, 40, pedal arms 46, etc.), changes in positional data from linear position sensor can be translated into useful exercise statistics such as stride length and stride period.

Many other configurations are possible including, but not limited to, mounting of the linear position sensor inside or alongside one or more of the springs 104, 106, or mounting of the linear position sensor at a position on the side of the crossed links opposite to spring 104. Other types of position sensors may be used in a manner similar to linear position sensors including, but not limited to, ultrasonic distance sensors, optical distance or position sensors, and strain gauges.

Figure 25:
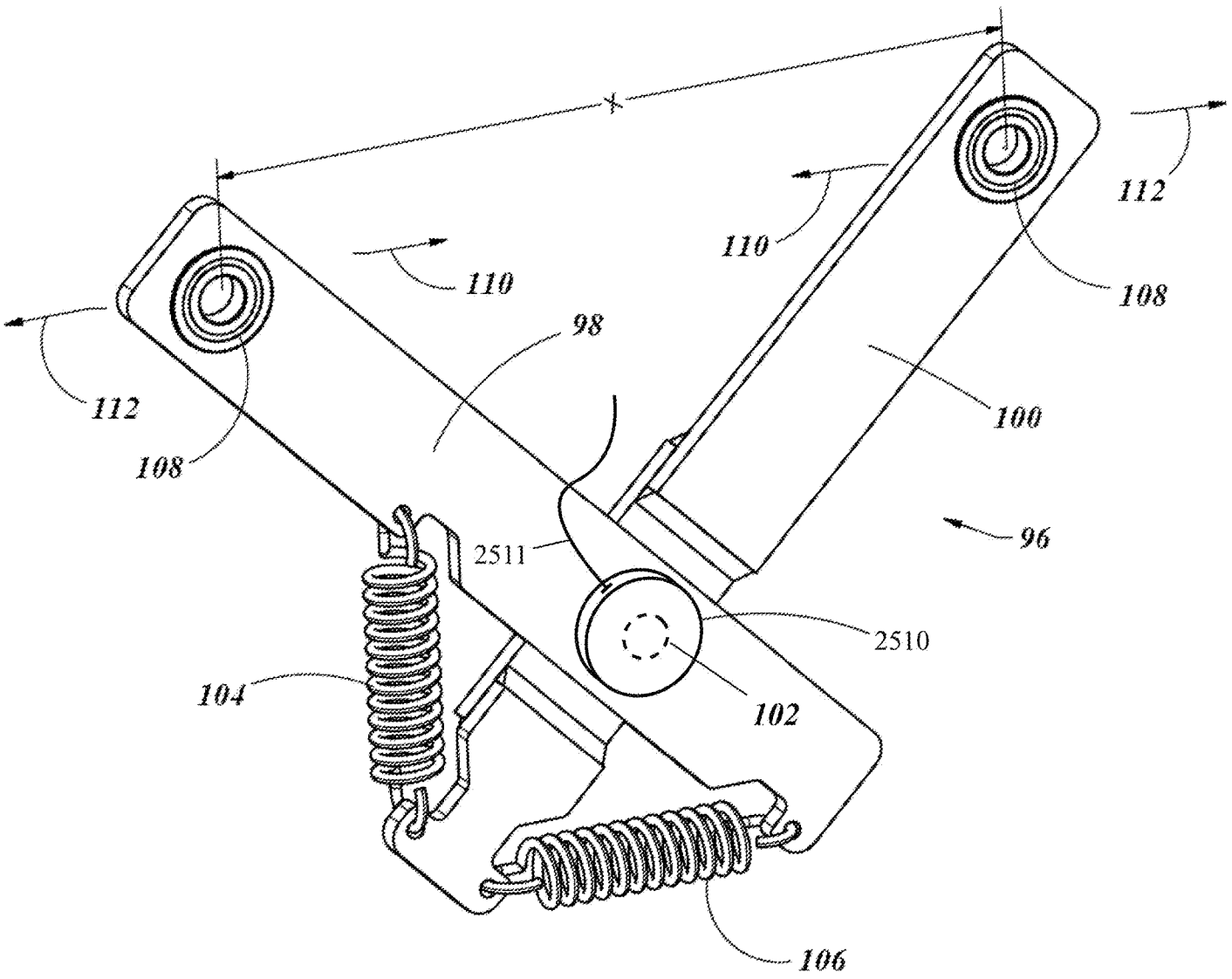
FIG. 25 is a diagram illustrating another exemplary sensor for detecting movement of a movable crank link.

FIG. 25 is a diagram illustrating another exemplary sensor for detecting movement of a movable crank link. Movable crank link 96 shown in this diagram is the same as that shown and described for FIG. 12, but with the addition of an angular position sensor 2510 to provide data regarding the amount of movement of movable crank link 96 during operation. Angular position sensor may be of any suitable type including, but not limited to, analog or digital type, resistive type or optical type, and incremental position encoding type or absolute position encoding type. Angular position sensor of this embodiment comprises a body 2510 comprising a fixed operational sensor component (e.g., a resistor coil or an encoded optical disk) and a rotating shaft (not shown) affixed to pivot 102 of movable crank link 96. comprising movable operational sensor component (e.g., an electrical contact for causing an electrical connection along the resistor coil or a magnet for causing an induction in the inductive coil). Body 2510 is affixed to one link 98 of movable crank link 96 rotating shaft (not shown) is affixed to pivot 102 which, in this configuration must be affixed to the other crank link 100 such that movement of crank links 98, 100 causes rotating shaft (not shown) to rotate inside body 2510 proportionally to the movement of the crank links 98, 100. Compression of the ends of movable crank link 96 in the direction shown at 110 or elongation of the ends of movable crank link 96 in the direction shown at 112 will cause rotating shaft (not shown) to rotate within body 2510 either clockwise or counter-clockwise, causing a position signal to be transmitted via wires 2511 to an appropriate computing device for data capture, storage, and use. As the mechanical characteristics of exercise machine are known (e.g., lengths, attachment points, and attachment angles, of crank links 98, 100, crank arms 38, 40, pedal arms 46, etc.), changes in positional data from linear position sensor can be translated into useful exercise statistics such as stride length and stride period.

Many other configurations are possible including, but not limited to, mounting of the linear position sensor inside or alongside one or more of the springs 104, 106, or mounting of the linear position sensor at a position on the side of the crossed links opposite to spring 104. Other types of position sensors may be used in a manner similar to linear position sensors including, but not limited to, ultrasonic distance sensors, optical distance or position sensors, and strain gauges.

Figure 26:
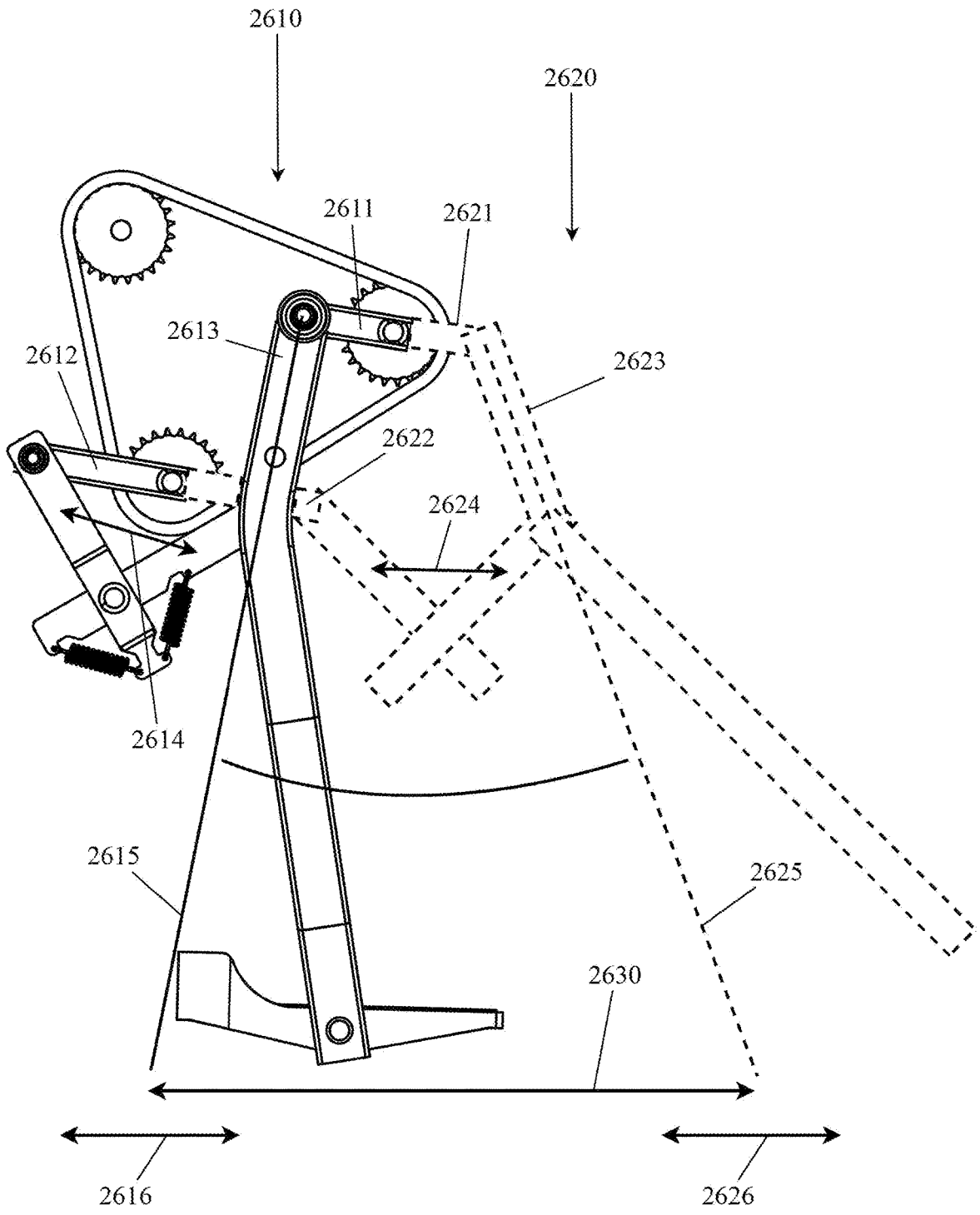
FIG. 26 is a diagram illustrating an exemplary method for calculation of stride length in an embodiment having movable crank links.

FIG. 26 is a diagram illustrating an exemplary method for calculation of stride length in an embodiment having movable crank link. As movement data is obtained from sensors place about exercise device 20, useful exercise statistics such as stride length and stride period can be calculated. As the mechanical characteristics of exercise machine are known (e.g., lengths, attachment points, and attachment angles, of crank links 98, 100, crank arms 38, 40, pedal arms 46, etc.), changes in positional data from position sensors located about exercise device 20 can be translated into useful exercise statistics such as stride length and stride period.

An example of such calculations is shown in this diagram. Here, a simplified view of a single side of the natural motion exercise mechanism is shown without frame 22. The components of the natural motion exercise mechanism are shown in a first position 2610 corresponding to rotation of crank arms 2611, 2612 in a forward position (shown in solid lines) and in a second position 2620 corresponding to rotation of crank arms 2621, 2611 to a backward position (180 degrees of rotation from the forward position; shown in dashed lines). As the length and angles of attachment of the various components of the natural motion exercise mechanism are known a stride length can be calculated as a base stride length 2630 from a forward-most position of the pedal 2615 in the first position 2610 to a backward-most position of the pedal 2625 in the second position, plus an offset at each end 2616, 2626 of base stride length corresponding to compression or extension of movable crank link 2614 in first position 2610 and compression or extension of movable crank link 2624 in second position 2620.

This principle of using sensor position information with known mechanical characteristics of exercise device 20 can be used to calculate other useful exercise statistics including, but not limited to, stride length variability, stride period variability, stride height, stride height variability, instantaneous or average power expended during exercise, and total work performed during exercise.

Figure 27:
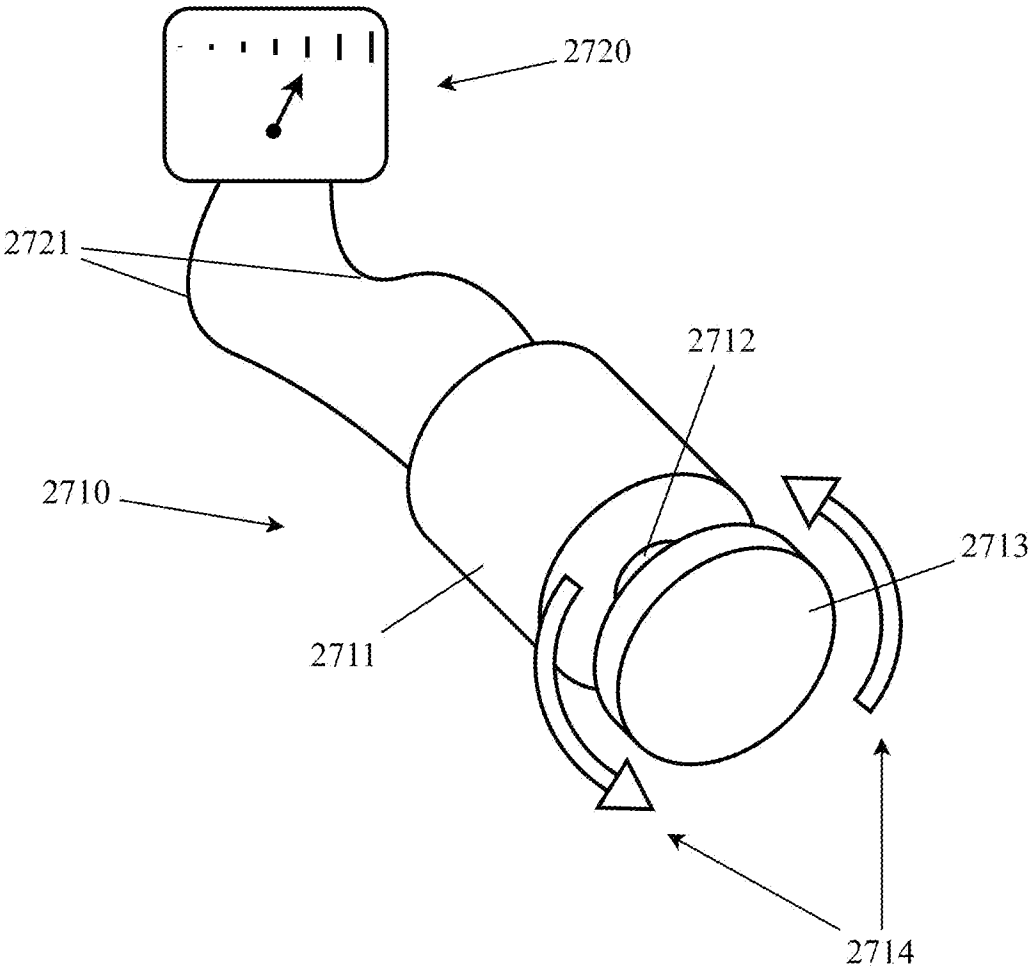
FIG. 27 is a diagram illustrating use of a direct current generator to determine power output of a user during exercise.

FIG. 27 is a diagram illustrating use of a direct current generator to determine power output of a user during exercise. Several means exist for capturing data related to power output of a user during exercise. A common method for determining power output on bicycles, for example, is to affix a strain gauge to the crank arms of the cranks (or integrate the strain gauge in to the crank arms), take a reading of the force applied to the crank arms during use, and calculate the power applied to the pedals during each rotation of the cranks using the force readings. The same method could be applied to exercise device 20 by affixing a strain gauge to some component of the natural motion exercise mechanism, such as the pedal arms, and making similar calculations. The method shown here uses a direct current (DC) generator 2710 comprising a generator housing having internal induction coils as in a typical DC motor, a drive shaft 2712 having permanent magnets arranged to generate an electrical current in the induction coils during rotation of the drive shaft, and a pulley or gear 2713 engaged with the belt or chain of control system 44. Rotation of control system 44 causes the belt or chain (e.g., belt 137) engaged with pulley or gear 2713 to rotate pulley or gear 2713, generating a current along wires 2721, measurable by a current meter 2720. Using the known electrical characteristics of DC generator such as the current known to be generated by DC motor as various revolution per minute (RPM) speeds, combined with the known characteristics of exercise device 20 such as the length of the pedal arms and the known resistance to movement of its braking system at its current braking setting, the measured current can be converted into an instantaneous power output in watts. In other embodiments, particularly those in which the braking system comprises a electromagnetic resistance mechanism, the power might be measured directly from the braking system as a proportion of the current flowing through the electromagnetic resistance mechanism (which is generally proportional to the rotation speed of the shaft or disc of the electromagnetic resistance mechanism).

Figure 28:
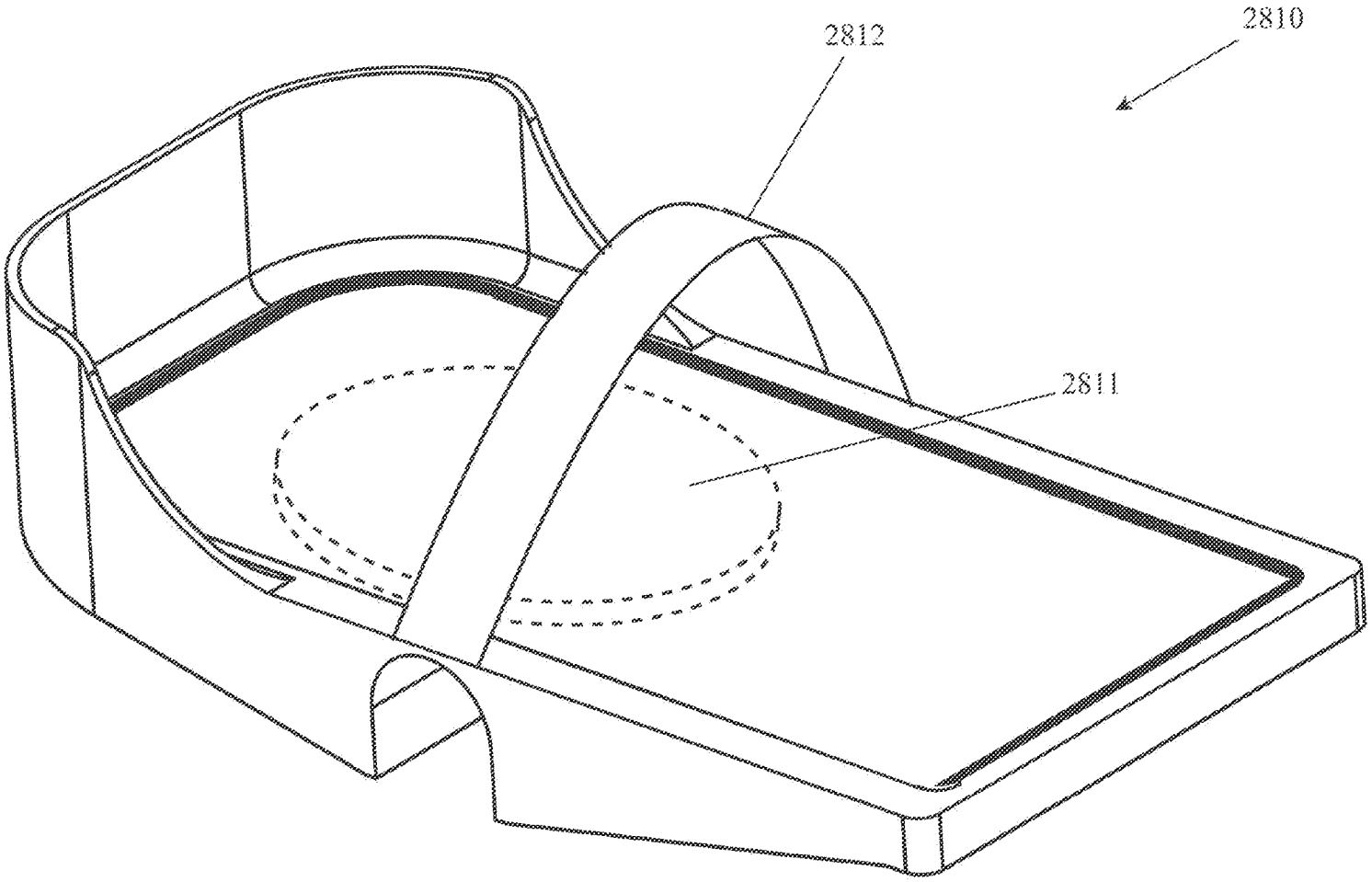
FIG. 28 is a diagram illustrating an exemplary footpad for detecting pressure and lift of a user's foot during exercise.

FIG. 28 is a diagram illustrating an exemplary footpad for detecting pressure and lift of a user's foot during exercise. For some applications, such as walking or running gait detection or analysis, it is useful to have sensor data showing a downward pressure applied by a user's foot onto a footpad or pedal or an upward lift pressure of the user's foot away from the footpad or pedal. Here, an pressure sensor 2811 is shown integrated into a footpad or pedal 2810, along with a strap 2812 configured to rest across the top of a user's foot.

Pressure sensor 2811 is configured to measure a downward pressure applied by a user's foot onto footpad or pedal 2810 which can be sent to a computing device as pressure data comprising a magnitude of the force applied, the speed at which the force is applied, a time of application of the force, etc., which pressure data can be captured over time to provide additional information such as a period of application of force. Depending on configuration, pressure sensor 2811 may be of various configurations such as having a resistive, capacitive, piezo-electric, or optical, or other force sensor technology.

Strap 2812 is configured to measure an upward lift pressure of the user's foot away from the footpad or pedal applied by the top of a user's foot against strap 2812 which can be sent to a computing device as pressure data comprising a magnitude of the force applied, the speed at which the force is applied, a time of application of the force, etc., which pressure data can be captured over time to provide additional information such as a period of application of force. Depending on configuration, strap 2812 may be of various configurations such as having a strain gauge integrated into its material, having a pressure sensor affixed to the underside of strap 2812, or having one or both ends of strap affixed to a strain gauge or force sensor.

In another configuration (not shown), footpad or pedal 2810 may be configured on a rotational platform with a rotary encoder or other mechanism for determining the angle of rotation of the user's foot during exercise.

Data from the above-described pressure sensors and rotational sensors can be used to calculate useful exercise statistics including, but not limited to, a periodicity of a user's gait, variations in the periodicity of a user's gait, discrepancies in sided-ness of the user's gait (e.g., indicating a preference for right side over left side or vice-versa, possibly indicating a disability or movement restriction), changes in, or discrepancies in, a user's foot angle or rotation during certain exercises or motions, or discrepancies in sided-ness of the user's foot angle or rotation (again, possibly indicating some disability or movement restriction).

Hardware Architecture

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit (ASIC), or on a network interface card.

Software/hardware hybrid implementations of at least some of the aspects disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific aspects, at least some of the features or functionalities of the various aspects disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some aspects, at least some of the features or functionalities of the various aspects disclosed herein may be implemented in one or more virtualized computing environments (e.g., network computing clouds, virtual machines hosted on one or more physical computing machines, or other appropriate virtual environments).

Figure 29:
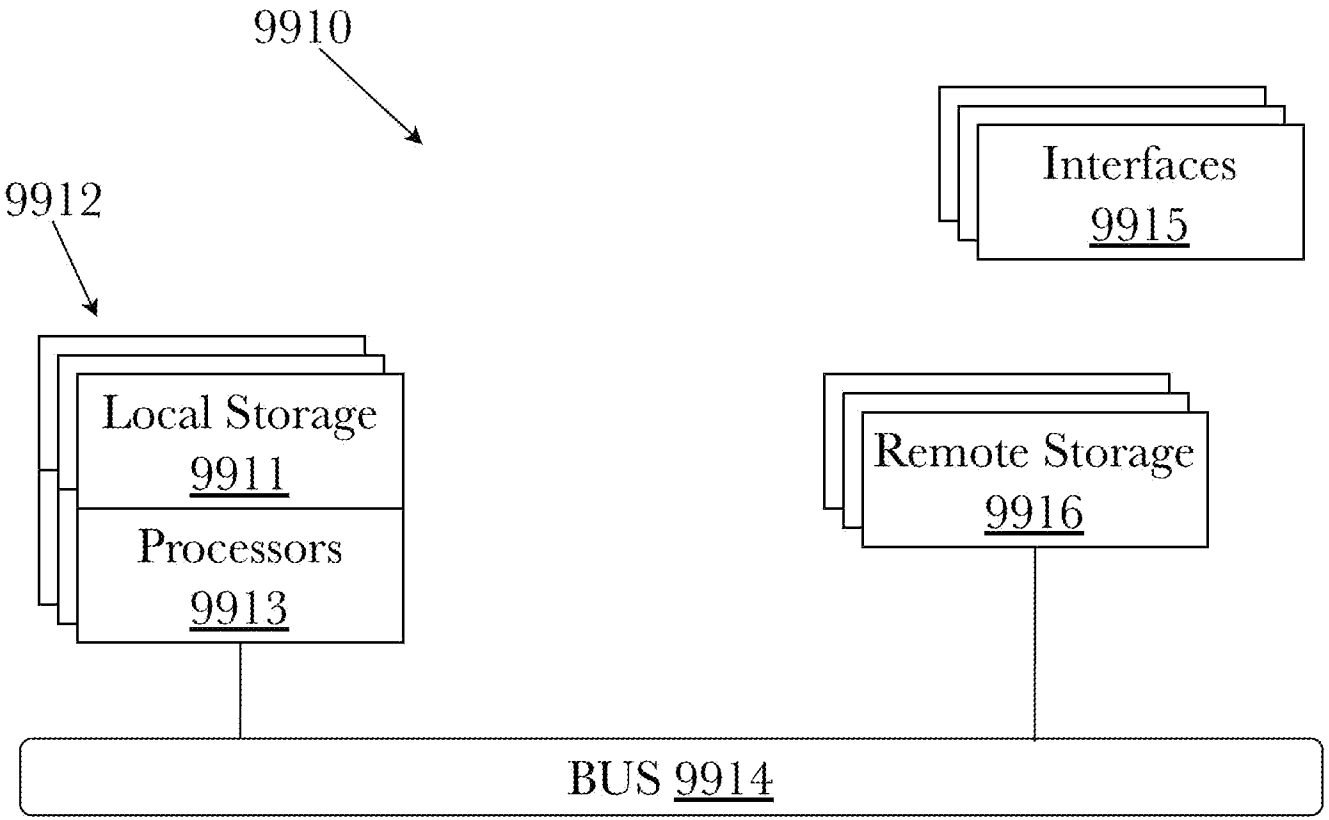
FIG. 29 is a block diagram illustrating an exemplary hardware architecture of a computing device.
Figure 30:
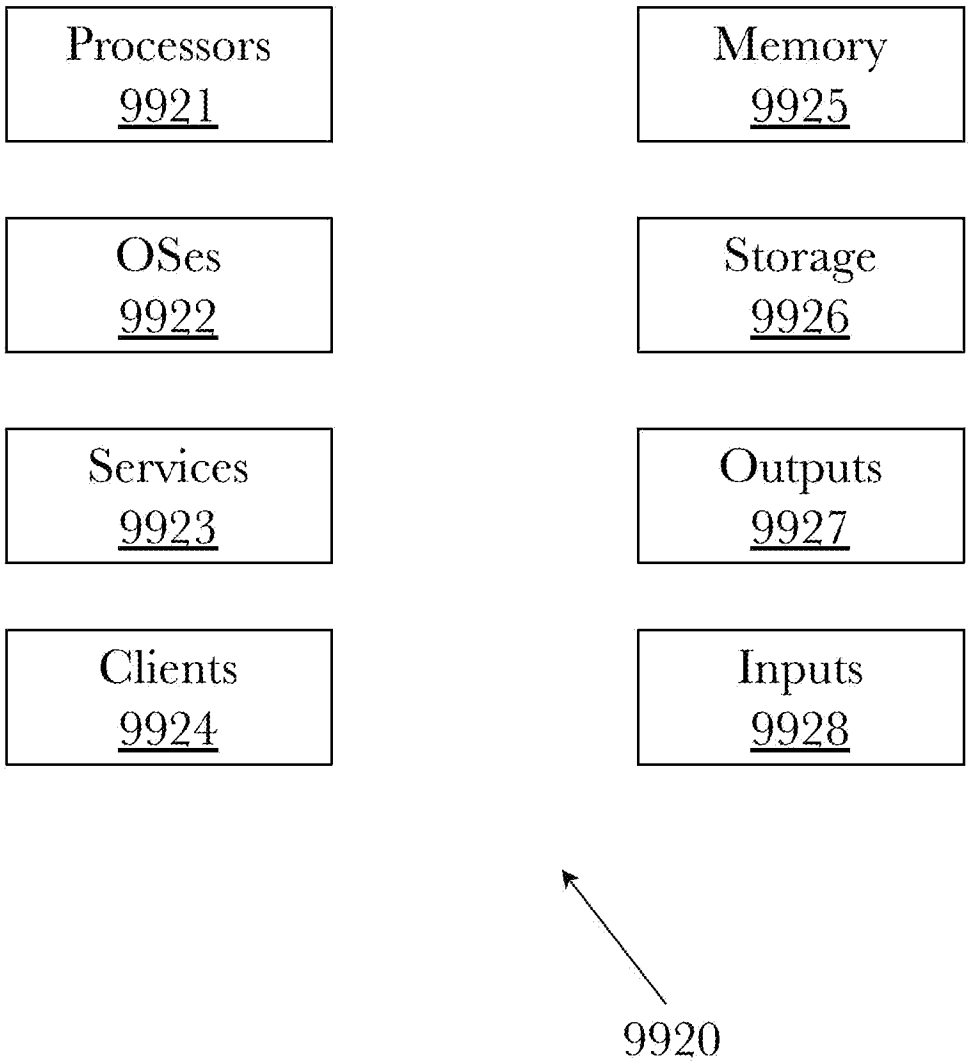
FIG. 30 is a block diagram illustrating an exemplary logical architecture for a client device.
Figure 31:
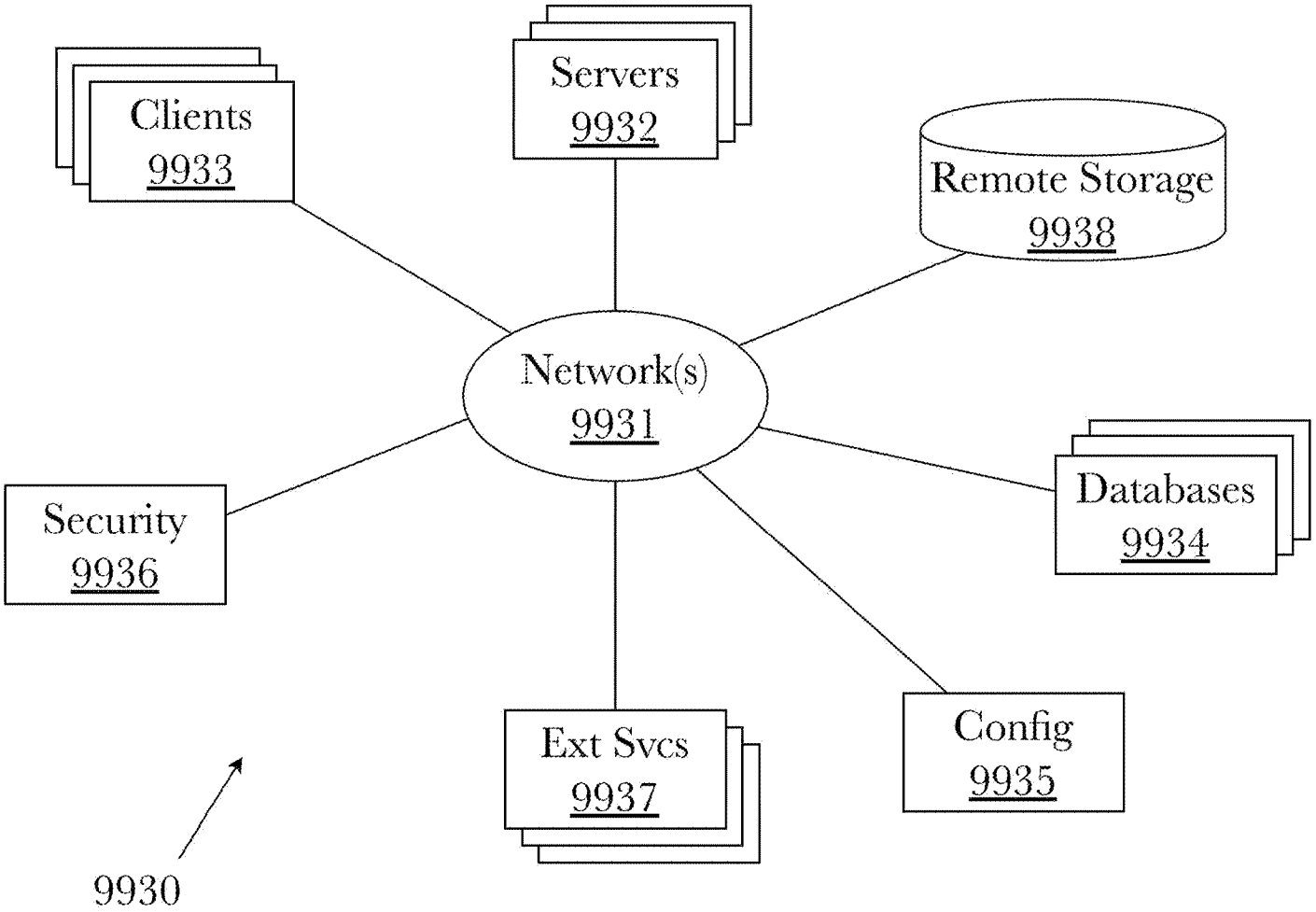
FIG. 31 is a block diagram showing an exemplary architectural arrangement of clients, servers, and external services.
Figure 32:
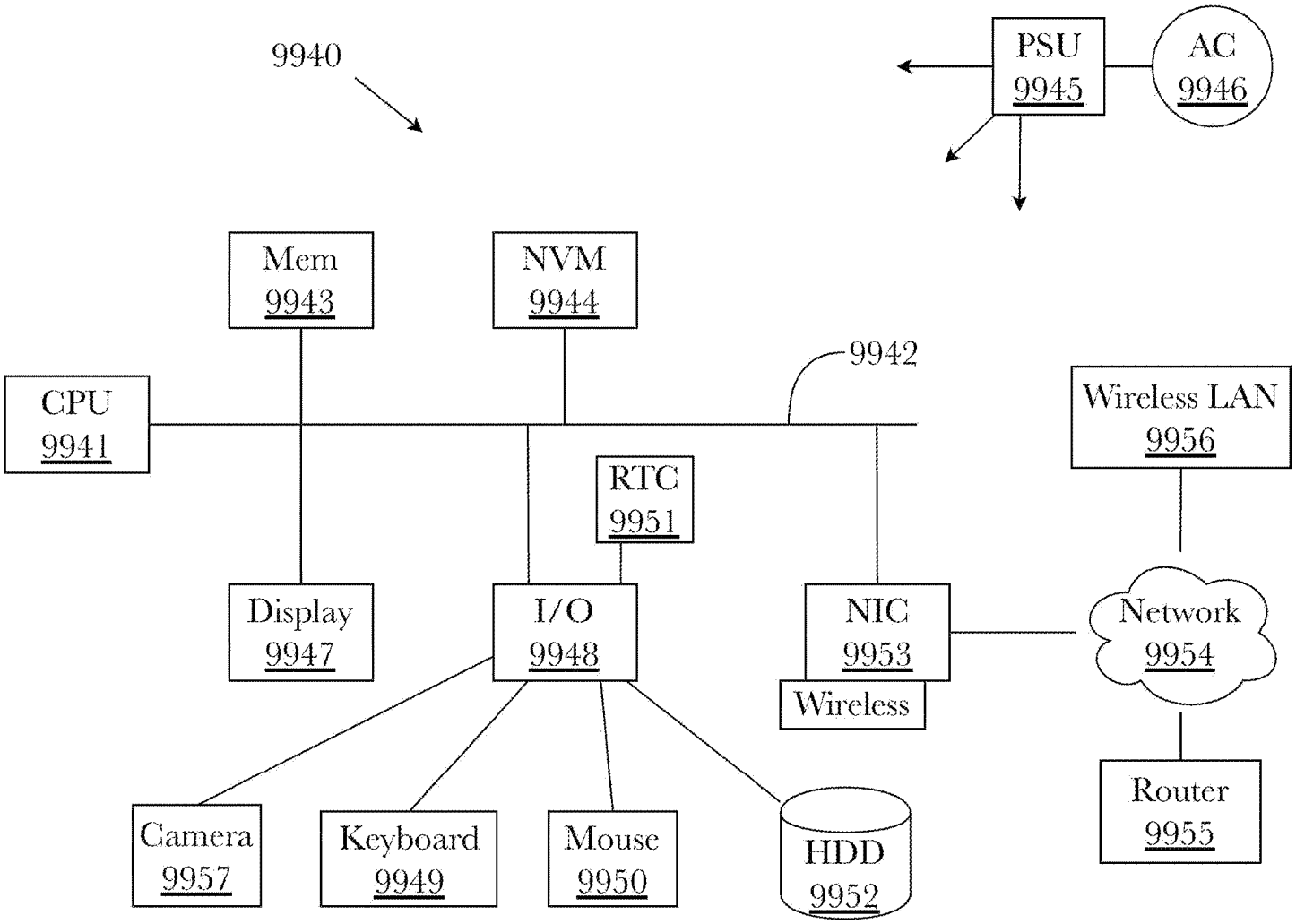
FIG. 32 is another block diagram illustrating an exemplary hardware architecture of a computing device.

Referring now to FIG. 29, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one aspect, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one aspect, a computing device 10 may be configured or designed to function as a server system utilizing CPU 12, local memory 11 and/or remote memory 16, and interface(s) 15. In at least one aspect, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some aspects, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a particular aspect, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one aspect, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity A/V hardware interfaces) and, in some instances, volatile and/or non-volatile memory (e.g., RAM).

Although the system shown in FIG. 9929 illustrates one specific architecture for a computing device 9910 for implementing one or more of the aspects described herein, it is by no means the only device architecture on which at least a portion of the features and techniques described herein may be implemented. For example, architectures having one or any number of processors 9913 may be used, and such processors 9913 may be present in a single device or distributed among any number of devices. In one aspect, a single processor 9913 handles communications as well as routing computations, while in other aspects a separate dedicated communications processor may be provided. In various aspects, different types of features or functionalities may be implemented in a system according to the aspect that includes a client device (such as a tablet device or smartphone running client software) and server systems (such as a server system described in more detail below).

Regardless of network device configuration, the system of an aspect may employ one or more memories or memory modules (such as, for example, remote memory block 9916 and local memory 9911) configured to store data, program instructions for the general-purpose network operations, or other information relating to the functionality of the aspects described herein (or any combinations of the above). Program instructions may control execution of or comprise an operating system and/or one or more applications, for example. Memory 9916 or memories 9911, 9916 may also be configured to store data structures, configuration data, encryption data, historical system operations information, or any other specific or generic non-program information described herein.

Because such information and program instructions may be employed to implement one or more systems or methods described herein, at least some network device aspects may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

In some aspects, systems may be implemented on a standalone computing system. Referring now to FIG. 9930, there is shown a block diagram depicting a typical exemplary architecture of one or more aspects or components thereof on a standalone computing system. Computing device 9920 includes processors 9921 that may run software that carry out one or more functions or applications of aspects, such as for example a client application 9924. Processors 9921 may carry out computing instructions under control of an operating system 9922 such as, for example, a version of MICROSOFT WINDOWS™ operating system, APPLE macOS™ or iOS™ operating systems, some variety of the Linux operating system, ANDROID™ operating system, or the like. In many cases, one or more shared services 9923 may be operable in system 9920, and may be useful for providing common services to client applications 9924. Services 9923 may for example be WINDOWS™ services, user-space common services in a Linux environment, or any other type of common service architecture used with operating system 9921. Input devices 9928 may be of any type suitable for receiving user input, including for example a keyboard, touchscreen, microphone (for example, for voice input), mouse, touchpad, trackball, or any combination thereof. Output devices 9927 may be of any type suitable for providing output to one or more users, whether remote or local to system 9920, and may include for example one or more screens for visual output, speakers, printers, or any combination thereof. Memory 9925 may be random-access memory having any structure and architecture known in the art, for use by processors 9921, for example to run software. Storage devices 9926 may be any magnetic, optical, mechanical, memristor, or electrical storage device for storage of data in digital form (such as those described above, referring to FIG. 9929). Examples of storage devices 9926 include flash memory, magnetic hard drive, CD-ROM, and/or the like.

In some aspects, systems may be implemented on a distributed computing network, such as one having any number of clients and/or servers. Referring now to FIG. 9931, there is shown a block diagram depicting an exemplary architecture 9930 for implementing at least a portion of a system according to one aspect on a distributed computing network. According to the aspect, any number of clients 9933 may be provided. Each client 9933 may run software for implementing client-side portions of a system; clients may comprise a system 9920 such as that illustrated in FIG. 9930. In addition, any number of servers 9932 may be provided for handling requests received from one or more clients 9933. Clients 9933 and servers 9932 may communicate with one another via one or more electronic networks 9931, which may be in various aspects any of the Internet, a wide area network, a mobile telephony network (such as CDMA or GSM cellular networks), a wireless network (such as WiFi, WiMAX, LTE, and so forth), or a local area network (or indeed any network topology known in the art; the aspect does not prefer any one network topology over any other). Networks 9931 may be implemented using any known network protocols, including for example wired and/or wireless protocols.

In addition, in some aspects, servers 9932 may call external services 9937 when needed to obtain additional information, or to refer to additional data concerning a particular call. Communications with external services 9937 may take place, for example, via one or more networks 9931. In various aspects, external services 9937 may comprise web-enabled services or functionality related to or installed on the hardware device itself. For example, in one aspect where client applications 9924 are implemented on a smartphone or other electronic device, client applications 9924 may obtain information stored in a server system 9932 in the cloud or on an external service 9937 deployed on one or more of a particular enterprise's or user's premises. In addition to local storage on servers 9932, remote storage 9938 may be accessible through the network(s) 9931.

In some aspects, clients 9933 or servers 9932 (or both) may make use of one or more specialized services or appliances that may be deployed locally or remotely across one or more networks 9931. For example, one or more databases 9934 in either local or remote storage 9938 may be used or referred to by one or more aspects. It should be understood by one having ordinary skill in the art that databases in storage 9934 may be arranged in a wide variety of architectures and using a wide variety of data access and manipulation means. For example, in various aspects one or more databases in storage 9934 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some aspects, variant database architectures such as column-oriented databases, in-memory databases, clustered databases, distributed databases, or even flat file data repositories may be used according to the aspect. It will be appreciated by one having ordinary skill in the art that any combination of known or future database technologies may be used as appropriate, unless a specific database technology or a specific arrangement of components is specified for a particular aspect described herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, some aspects may make use of one or more security systems 9936 and configuration systems 9935. Security and configuration management are common information technology (IT) and web functions, and some amount of each are generally associated with any IT or web systems. It should be understood by one having ordinary skill in the art that any configuration or security subsystems known in the art now or in the future may be used in conjunction with aspects without limitation, unless a specific security 9936 or configuration system 9935 or approach is specifically required by the description of any specific aspect.

FIG. 9932 shows an exemplary overview of a computer system 9940 as may be used in any of the various locations throughout the system. It is exemplary of any computer that may execute code to process data. Various modifications and changes may be made to computer system 9940 without departing from the broader scope of the system and method disclosed herein. Central processor unit (CPU) 9941 is connected to bus 9942, to which bus is also connected memory 9943, nonvolatile memory 9944, display 9947, input/output (I/O) unit 9948, and network interface card (NIC) 9953. I/O unit 9948 may typically, be connected to peripherals such as a keyboard 9949, pointing device 9950, hard disk 9952, real-time clock 9951, a camera 9957, and other peripheral devices. NIC 9953 connects to network 9954, which may be the Internet or a local network, which local network may or may not have connections to the Internet. The system may be connected to other computing devices through the network via a router 9955, wireless local area network 9956, or any other network connection. Also shown as part of system 9940 is power supply unit 9945 connected, in this example, to a main alternating current (AC) supply 9946. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In various aspects, functionality for implementing systems or methods of various aspects may be distributed among any number of client and/or server components. For example, various software modules may be implemented for performing various functions in connection with the system of any particular aspect, and such modules may be variously implemented to run on server and/or client components.

The skilled person will be aware of a range of possible modifications of the various aspects described above. Accordingly, the present invention is defined by the claims and their equivalents.

What is claimed is:

1. An exercise device comprising:

a frame;

a first and a second crank system mounted opposing sides of the frame adapted for positioning a user therebetween, each of the first and second crank system comprising a first crank assembly rotatable about a first axis and a second crank assembly rotatable about a second axis with the first and second axes each being displaced from the other, each of the first crank assemblies comprising a first crank arm, and each of the second crank assemblies comprising a second crank arm;

a pair of synchronous control system assemblies, one mechanically coupled to the first crank system and the other mechanically coupled to the second crank system, each synchronous control system assembly of the pair of synchronous control system assemblies being mechanically coupled to the first and second crank assemblies of the corresponding crank system in a configuration that allows for 360 degrees of synchronous rotation of the first and second crank assemblies, wherein each first crank arm of each first crank assembly rotates in the same direction as the second crank arm of each second crank assembly by the corresponding synchronous control system assembly of the pair of synchronous control system assemblies;

a pair of pedal arms, one coupled to the first crank system and the other coupled to the second crank system, each of the pair of pedal arms being pivotally coupled at a first end to the first crank arm of the corresponding first crank assembly and being pivotally coupled at a second end to a pedal;

a pair of movable crank links, one corresponding to each of the first and second crank systems, each movable crank link of the pair of movable crank links comprising a first link and a second link, a first attachment point proximal to a first end of the first link, a second attachment point proximal to a first end of the second link, and a flexible attachment between the first attachment point and second attachment point, the flexible attachment comprising a pivoting attachment of the first link to the second link, wherein the first attachment point of each movable crank link is pivotally coupled to the pedal arm of its corresponding crank system and the second attachment point of each movable crank link is pivotally coupled to the second crank arm of the corresponding second crank assembly.

2. The exercise device of claim 1, wherein for each movable crank link of the pair of movable crank links, the pivoting attachment is at a medial location of both the first and second links, such that a second end of the first link distal from the first attachment point extends past the pivoting attachment and a second end of the second link distal from the second attachment point extends past the pivoting attachment.

3. The exercise device of claim 2, wherein for each movable crank link of the pair of movable crank links, a first spring is attached between the second end of the first link and the second end of the second link.

4. The exercise device of claim 3, further comprising a second spring for each movable crank link of the pair of movable crank links, wherein for one movable crank link of the pair of movable crank links, the second spring is attached between the second end of the first link and a location on the second link between the first end of the second link and the medial location of the second link, and for the other movable crank link of the pair of movable crank links, the second spring is attached between the second end of the second link and a location on the first link between the first end of the first link and the medial location of the first link.

5. The exercise device of claim 1, further comprising a sensor to convert a degree of mechanical motion of at least one moveable crank link of the pair of movable crank links into an electrical signal.

* * * * *